United States Patent [19]

Csicsatka

[11] 3,934,092

[45] Jan. 20, 1976

[54] FOUR CHANNEL STEREOPHONIC BROADCASTING SYSTEM

[75] Inventor: Antal Csicsatka, Utica, N.Y.

[73] Assignee: General Electric Company, Syracuse, N.Y.

[22] Filed: Dec. 1, 1972

[21] Appl. No.: 311,195

Related U.S. Application Data

[63] Continuation-in-part of Ser. No. 182,318, Sept. 21, 1971, abandoned.

[52] U.S. Cl. ..... 179/15 BT

[51] Int. Cl.[2] ..... H04H 5/00

[58] Field of Search..... 179/15 BT, 1 GQ; 325/50, 325/65, 136

[56] References Cited

UNITED STATES PATENTS

| | | | |
|---|---|---|---|
| 3,083,337 | 3/1963 | Grimes | 325/65 |
| 3,375,444 | 3/1968 | Lomer | 325/65 |
| 3,549,811 | 12/1970 | Borresen | 325/50 |
| 3,679,832 | 7/1972 | Halpern | 179/15 BT |
| 3,708,623 | 1/1973 | Dorren | 179/15 BT |

OTHER PUBLICATIONS

Quart Ambience with Reference Tone by Gerzon Radio Electronics Dec. 1970.

System Delay Characteristics in NTSC Color Television by Palmer Proceedings IRE Jan. 1954.

Single Sideband Principles and Circuits by Pappenfus et al., McGraw-Hill Book Company copyright 1964 pp. 1–12.

Quadrasonics On The Air by Feldman Audio Magazine Jan. 1970.

The Quart Broadcasting System by Gerzon Audio Magazine Sept. 1970.

*Primary Examiner*—Kathleen H. Claffy
*Assistant Examiner*—Thomas D'Amico
*Attorney, Agent, or Firm*—Marvin A. Goldenberg

[57] ABSTRACT

A broadcast system capable of transmitting and receiving a broadcast signal containing four discrete stereophonically related audio frequency inputs in which there is produced within the transmitter four matrix outputs, each of which is a function of one or more of the inputs. A main carrier wave is then frequency modulated with the first matrix output, with the sidebands of a suppressed first and second subcarrier which has been amplitude modulated with the second and third matrix outputs in quadrature relationship with each other, and with the lower sideband and a relatively small portion of the upper sideband of a depressed third subcarrier that has been amplitude modulated with the fourth matrix output. The modulation of the third subcarrier is limited to a maximum voltage level substantially below the highest level otherwise possible. The first, second, and third subcarriers are regenerated in the receiver and the four matrix outputs are detected. These outputs are then dematrixed to reproduce the four original inputs. The restricted sideband modulation associated with the third subcarrier and the amplitude limiting of its modulation signal maintain the out-of-band radiation of the transmitted energy within acceptable limits.

31 Claims, 16 Drawing Figures

206
238
244
232
246
230
228
220
222
225
224
218
240
248
on
off
214
202
242
176
178
180
182
-15 V

FOUR CHANNEL STEREOPHONIC BROADCASTING SYSTEM

This application is a continuation-in-part of application for U.S. Letter Patent, Ser. No. 182,318, filed Sept. 21, 1971 now abandoned.

BACKGROUND OF THE INVENTION

This invention relates to a new and improved broadcast system, and more particularly, a frequency modulation broadcast system in which four discrete stereophonically related audio frequency inputs are transmitted and received.

It is well recognized that the realism and listening pleasure associated with broadcast or recorded music and other material can, in many instances, be increased substantially by providing a plurality of separate channels or audio inputs which are supplied to different speakers. Accordingly, two channel stereophonic systems have become commonplace, and most record discs and magnetic tape recordings are readily available in two channel stereophonic form. In addition, two channel stereophonic material is broadcast in accordance with standards that have been established by the Federal Communications Commission. A two channel stereophonic system of the type which has been adopted and standardized by the Federal Communications Commission is disclosed in my U.S. Pat. No. 3,122,610, issued on Feb. 25, 1964. It utilizes a first frequency band within which a main carrier wave is modulated with the sum of the left and the right channels. This main carrier wave is further frequency modulated with the sidebands of a suppressed subcarrier wave at 38 KHz that has been amplitude modulated with the difference between the left and right channels. A pilot signal is provided at 19 KHz within a gap between the two frequency bands to provide a basis for the local regeneration of the subcarrier in the receiver and to provide an indication of the presence of a stereophonic signal. This highly successful system is fully compatible with the prior monophonic, frequency-modulation broadcast systems.

It is now recognized that there are many advantages to a four channel stereophonic system in that it provides increased realism and listening pleasure as compared to a two channel system. This is particularly true, for instance, when the sound of a large concert hall is to be recreated. In that environment, the sound comes to the listener from many directions. A large part of this sound is reflected, thus introducing time delays which form a significant part of the listening experience. Four channel stereophonic music has been recorded on magnetic tapes and reproduced through speaker systems with good results. In addition, there has been some limited FM broadcasting of four channel stereophonic music utilizing two separate stations which are assigned different carrier frequencies.

It is important that a four channel stereophonic system be fully compatible with the large quantity of existing monophonic and two channel stereophonic equipment. If complete monophonic and two channel stereophonic information is to be provided for this equipment, the presently established sum and difference signals and the presently established 19 KHz pilot signal must be incorporated in the four channel system. Thus, the information needed to further break down the two existing stereophonic channels into four channels must be superimposed upon the established two channel stereophonic composite signal. It has not heretofore been known how to accomplish this objective without producing unacceptable out-of-band radiation.

There are a number of presently known stereophonic receivers which produce what may be termed a pseudo or hybrid four channel output. This is accomplished by matrixing the two conventional stereophonic inputs in the receiver, sometimes with the addition of time delays and loudness enhancement, to produce four inputs each of which may be different from the other three. These are not, however, four discrete inputs. They are four artificially created inputs, and the relationship between the inputs to the speakers is determined according to a formula which is preselected at the time the receiver is built. Some known systems utilize matrixing of four audio inputs at the transmitter, but only two channels are broadcast by the transmitter. However as in other hybrid systems, four channels of information are not broadcast by the transmitter, and the receiver is not equipped to detect this much information if it were present. Thus, the presently known four speaker receivers are inherently inferior because they are not part of an integrated system, including a transmitter and at least one receiver, designed to broadcast four discrete audio inputs.

SUMMARY OF THE INVENTION

In providing a broadcast system which will permit the transmission and reception of four discrete stereophonic inputs (channels) with transmission by a single frequency modulation station, it is, of course, necessary to do so without producing out-of-band radiation that would interfere with other stations. This can be accomplished if the four stereophonic inputs can be multiplexed onto a single main carrier wave without allowing the broadcast signal, including its harmonics, to at any time substantially exceed the present Federal Communications Commission's standards regarding frequency modulation broadcasting. It is important to provide a system in which the broadcast signal encompasses a minimum band width, because receiver design is inherently a compromise between adjacent channel selectivity and receiver channel band width.

My invention comprises both an apparatus and a method for transmitting and receiving a frequency modulated main carrier wave containing four discrete stereophonically related audio frequency inputs. The apparatus includes a transmitter and one or more receivers. The transmitter comprises a matrix means responsive to the four discrete inputs for producing four matrix outputs, each of which is a function of at least one of the inputs, means for generating a main carrier wave, and means for frequency modulating the main carrier wave with the first matrix output. It further comprises means for generating a first subcarrier wave, means for amplitude modulating the first subcarrier wave with the second matrix output, means for generating a second subcarrier wave at the same frequency as the first subcarrier wave and in quadrature relationship with the first subcarrier wave, means for amplitude modulating the second subcarrier wave with the third matrix output, means for suppressing the first and second subcarrier waves, and means for frequency modulating the main carrier wave with the sidebands of the modulated first and second subcarrier waves. The frequency of the first and second subcarrier waves is such that there is a gap between their lower sidebands and the frequency band of the first matrix output. A means is provided for generating a pilot signal at a frequency that is subharmonically related to the subcarrier frequencies and falls within the gap, and means is provided for frequency modulating the main carrier wave with the pilot signal.

The transmitting further includes means for generating a third subcarrier wave at a frequency above that of the first and second subcarrier waves, means for amplitude modulating the third subcarrier wave in accordance with the fourth matrix output, means for depressing or suppressing the third subcarrier wave and means for reducing the amplitude of the modulation of the third subcarrier wave, such as by a limiting operation to a maximum substantially below the highest level otherwise obtainable. A bandpass filter means is provided for removing all but a relatively small portion of the upper sideband of the thrid subcarrier wave and for attenuating the uppermost portion of the lower sideband of the third subcarrier wave. An equalizer means is provided for equalizing the travel time of signals of different frequencies which pass through the filter means. The transmitter further includes means for frequency modulating the main carrier with the remaining portions of the sidebands of the modulated third subcarrier wave. The frequency of the third subcarrier wave is such that its lower sideband is separated from the upper sidebands of the first and second subcarrier waves.

The noted filter means has a center frequency located at approximately the lower edge of the lower sideband of the third subcarrier wave so that the filter response characteristic is relatively flat at the higher modulation frequencies, which reduces the burden placed upon the equalizer means in achieving travel time equalization. Further, the upper skirt of the filter response exhibits about a 6 db attenuation, at the frequency of the third subcarrier wave, so that in the receiver the lower audio frequency signals can be readily demodulated with a voltage equal to that of the higher audio frequency signals. An added advantage of the present broadcast system with respect to band utilization, and principally owing to the employment of the referred to filter means, a relatively narrow band IF filter can be utilized in the receiver. A yet further advantage is that SCA (Subsidiary Communications Authorization) may be broadcast together with the four channel stereophonic signals.

The receiver of this system comprises means responsive to the pilot signal for regenerating and reinserting the first, second, and third subcarrier waves, means for detecting the four matrix outputs, and de-matrix means responsive to the four matrix outputs for reproducing the four discrete audio frequency inputs.

In the preferred embodiment of the system described above, assuming that the four discrete audio frequency inputs are represented by the symbols $L_F$, $L_R$, $R_F$, and $R_R$, the four matrix outputs represent functions of these inputs as follows:

The first matrix output represents
$L_F + L_R + R_F + R_R$;
The second matrix output represents
$(L_F + L_R) - (R_F + R_R)$;
The third matrix output represents
$(L_F - L_R) - (R_F - R_R)$; and
The fourth matrix output represents
$(L_F - L_R) + (R_F - R_R)$.

The limiting means limits the modulation of the third subcarrier wave to a maximum which lies between 30 and 90 percent of the highest level otherwise possible.

A maximum of 60 percent is optimum for most purposes.

As an additional feature the system may include, in the transmitter, means for generating a control signal which is indicative of the presence of four discrete stereophonically related audio frequency inputs, and, in the receiver, switching means responsive to the presence of the control signal for disconnecting a portion of the receiver when the control signal is not present. This switching means may also be arranged to provide a display that indicates the presence of the audio frequency inputs. Preferably, the indicator signal has the same frequency as the third subcarrier wave.

From another point of view, the invention comprises a method of transmitting and receiving a frequency modulated main carrier wave including four discrete stereophonically related inputs. This method comprises generating four matrix outputs each of which is a function of at least one of the four discrete audio frequency inputs, generating a main carrier wave, and modulating the main carrier wave with the first matrix output. The method further comprises generating a first subcarrier wave, amplitude modulating the first subcarrier wave with the second matrix output, generating a second subcarrier at the same frequency as the first subcarrier wave and in quadrature relationship with the first subcarrier wave, modulating the second subcarrier wave with the third matrix output, and suppressing the first and second subcarrier waves. The main carrier wave is then frequency modulated with the sidebands of the modulated first and second subcarrier waves. The frequency of the first and second subcarrier waves is such that there is a gap between the lower sidebands of the first and second subcarrier waves and the frequency band of the first matrix output. The method further comprises generating a pilot signal at a frequency that falls within the gap and modulating the main carrier wave with the pilot signal.

Further steps of the method are generating a third subcarrier wave at a frequency above that of the first and second subcarrier waves, amplitude modulating the third subcarrier wave with the fourth matrix output, depressing or suppressing the third subcarrier wave, reducing the amplitude of the modulation of the third subcarrier wave, such as by limiting, to a maximum substantially below the highest level otherwise possible, removing all but a relatively small portion of the upper sideband of the third subcarrier wave and attenuating the uppermost portion of the lower sideband of the third subcarrier wave, and equalizing the travel time of portions of the third subcarrier sidebands that are of different frequencies. The method further comprises modulating the main carrier wave with the remaining portions of the sidebands of the modulated third subcarrier wave. The frequency of the third subcarrier wave is such that its lower sideband is separated from the upper sidebands of the first and second subcarrier waves. The frequency modulated main carrier wave is then propagated and sensed with an antenna.

The method further comprises regenerating and reinserting the first, second and third subcarrier waves by multiplying the frequency of the pilot signal, detecting the four matrix outputs, and reproducing from the four matrix outputs the four discrete audio frequency signals.

BRIEF DESCRIPTION OF THE DRAWINGS

For a more complete understanding of the present invention reference may be had to the detailed description which follows and to the accompanying drawings in which.

DESCRIPTION OF THE PREFERRED EMBODIMENT

Figure 2:
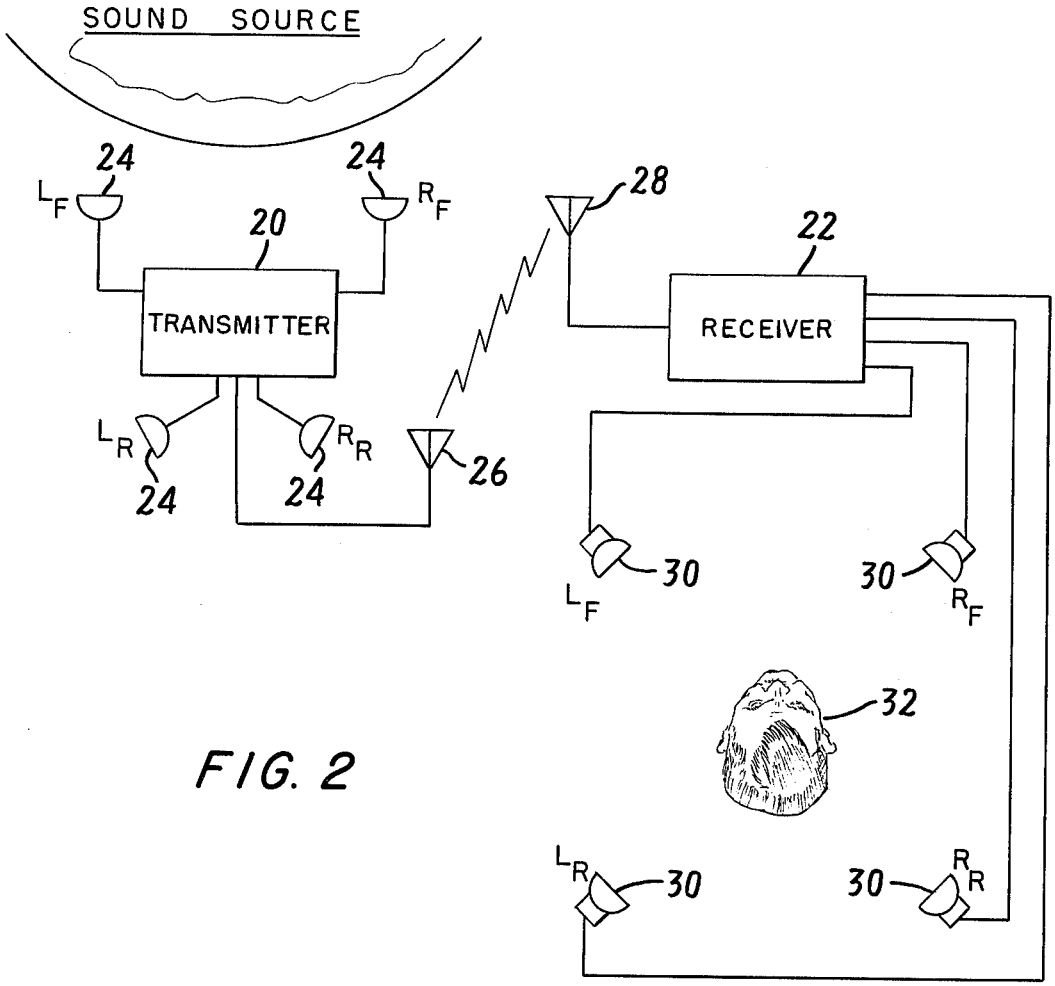
FIG. 2 is a pictorial representation of a broadcast system constructed in accordance with the invention.
Figure 3A:
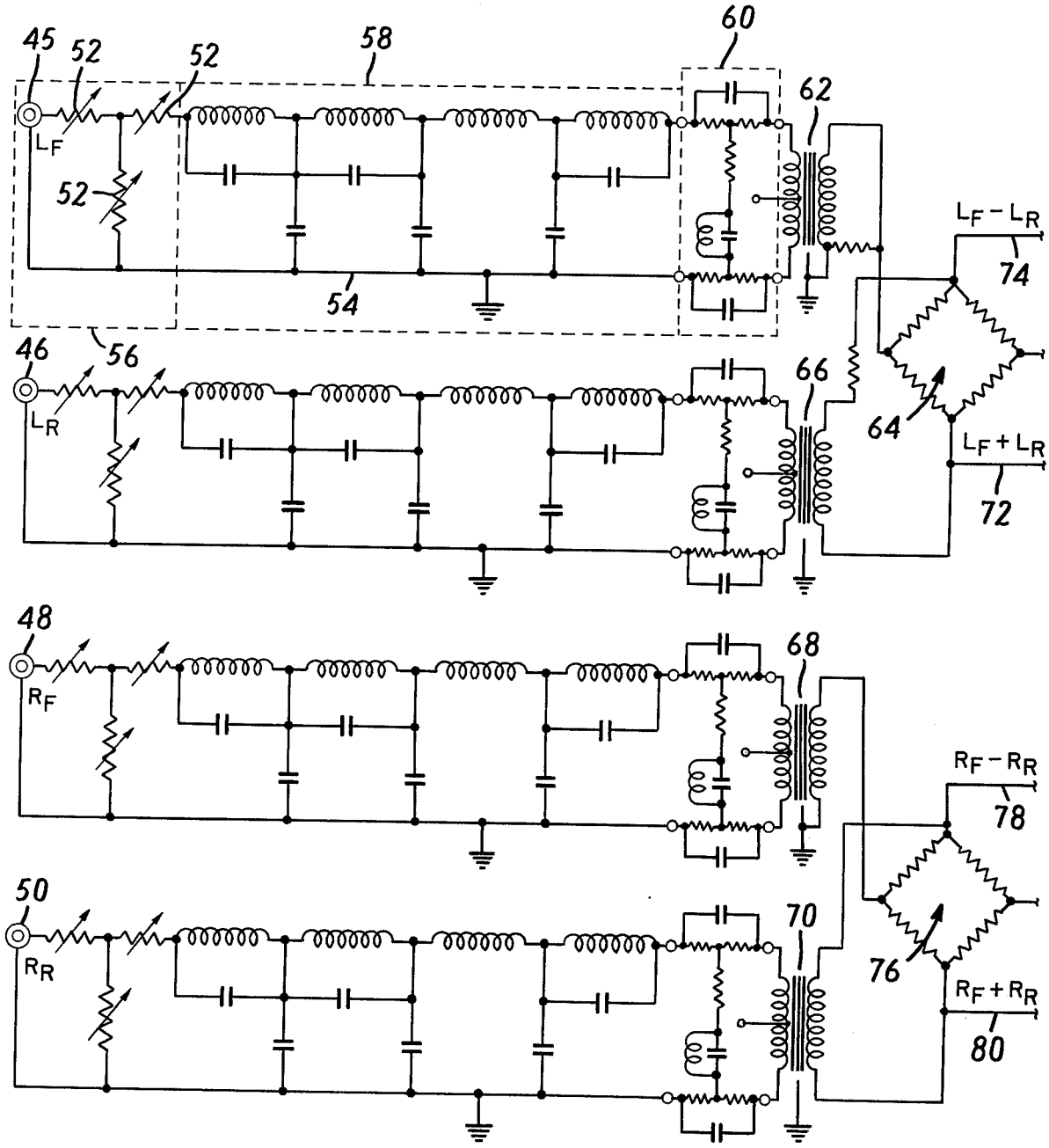
FIGS. 3*a*, 3*b*, 4*a*, 4*b*, 5*a*, and 5*b* are schematic representations of portions of a transmitter that is part of the system of FIG. 2.
Figure 3B:
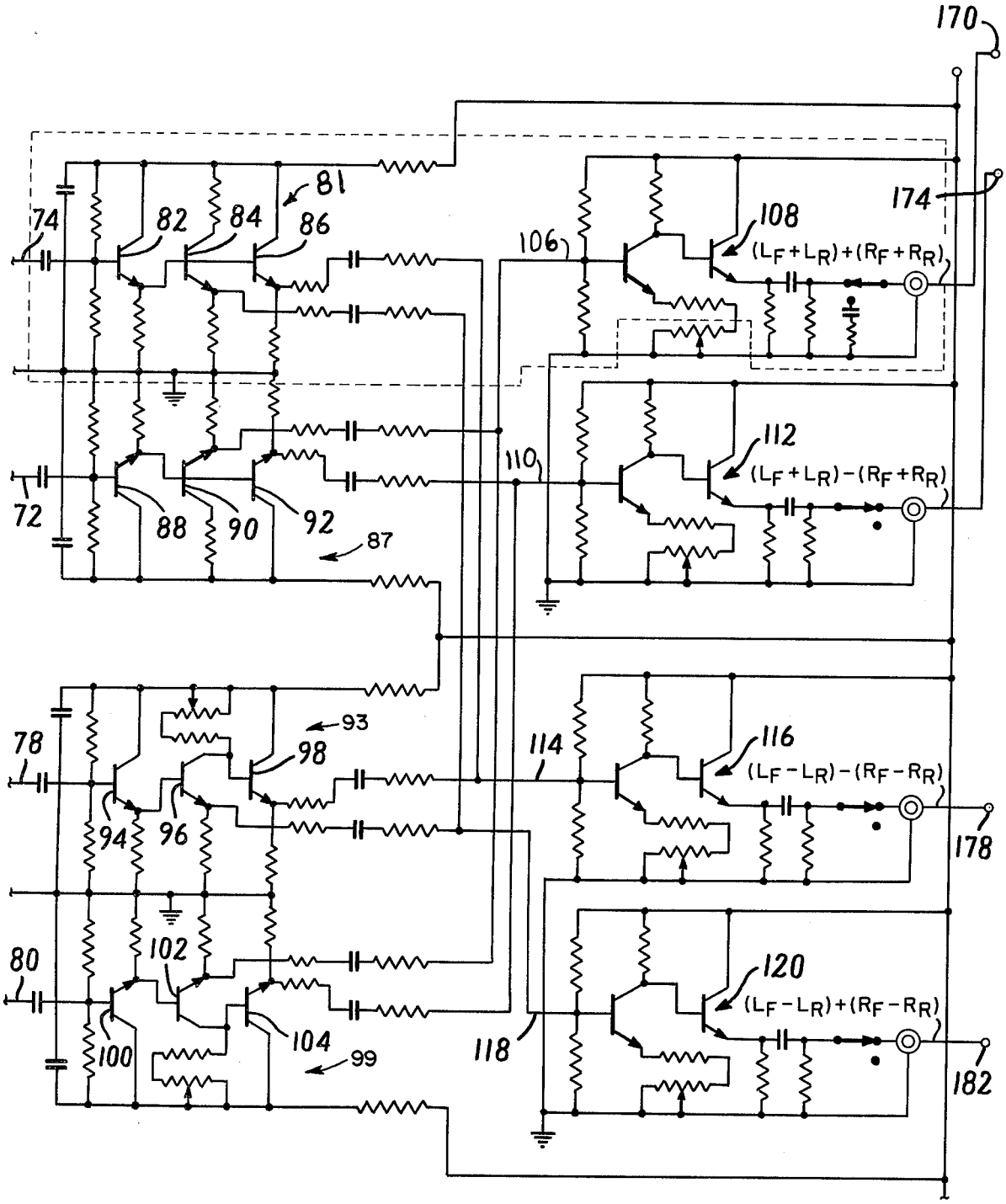
Figure 4A:
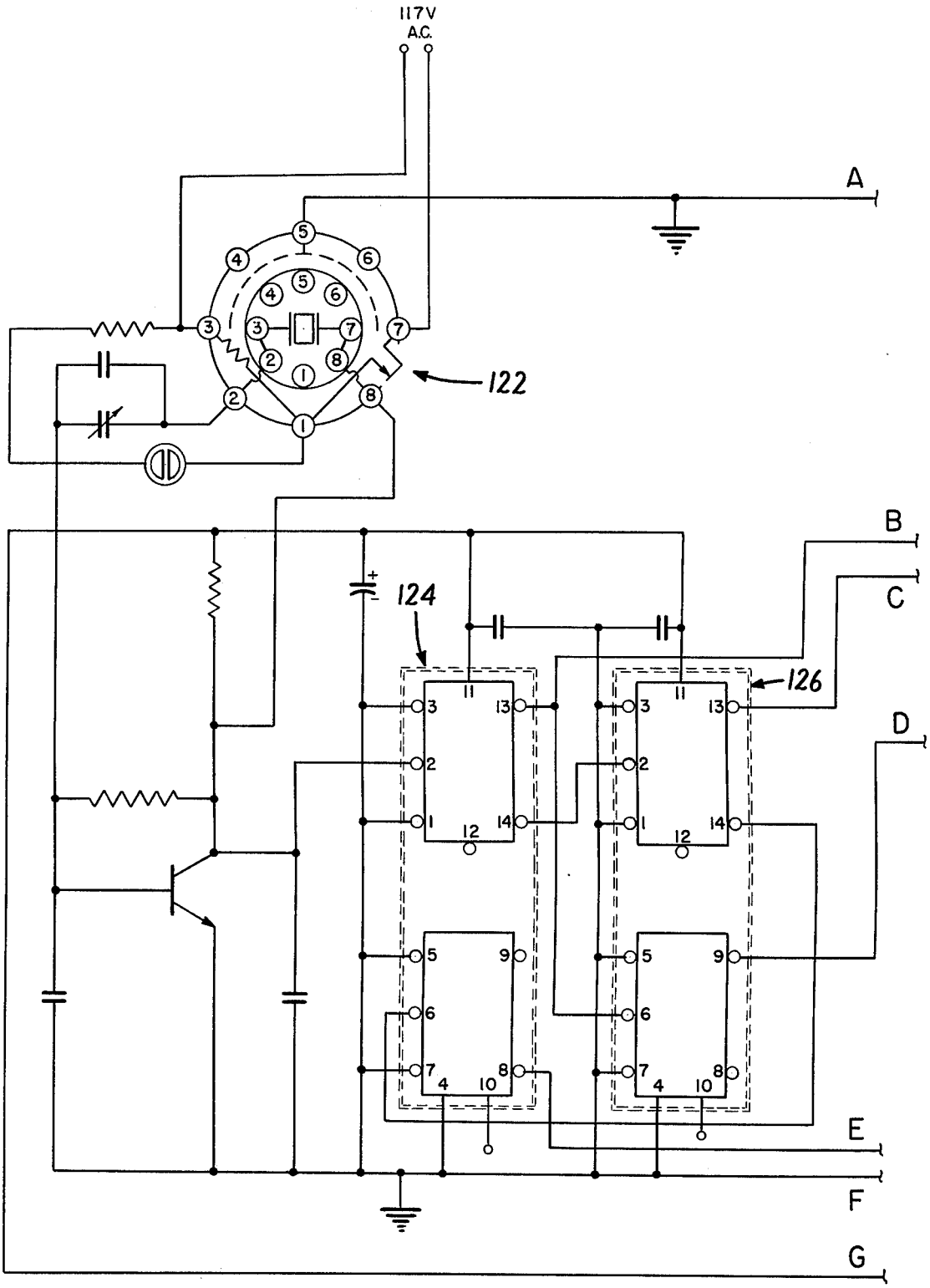
Figure 4B:
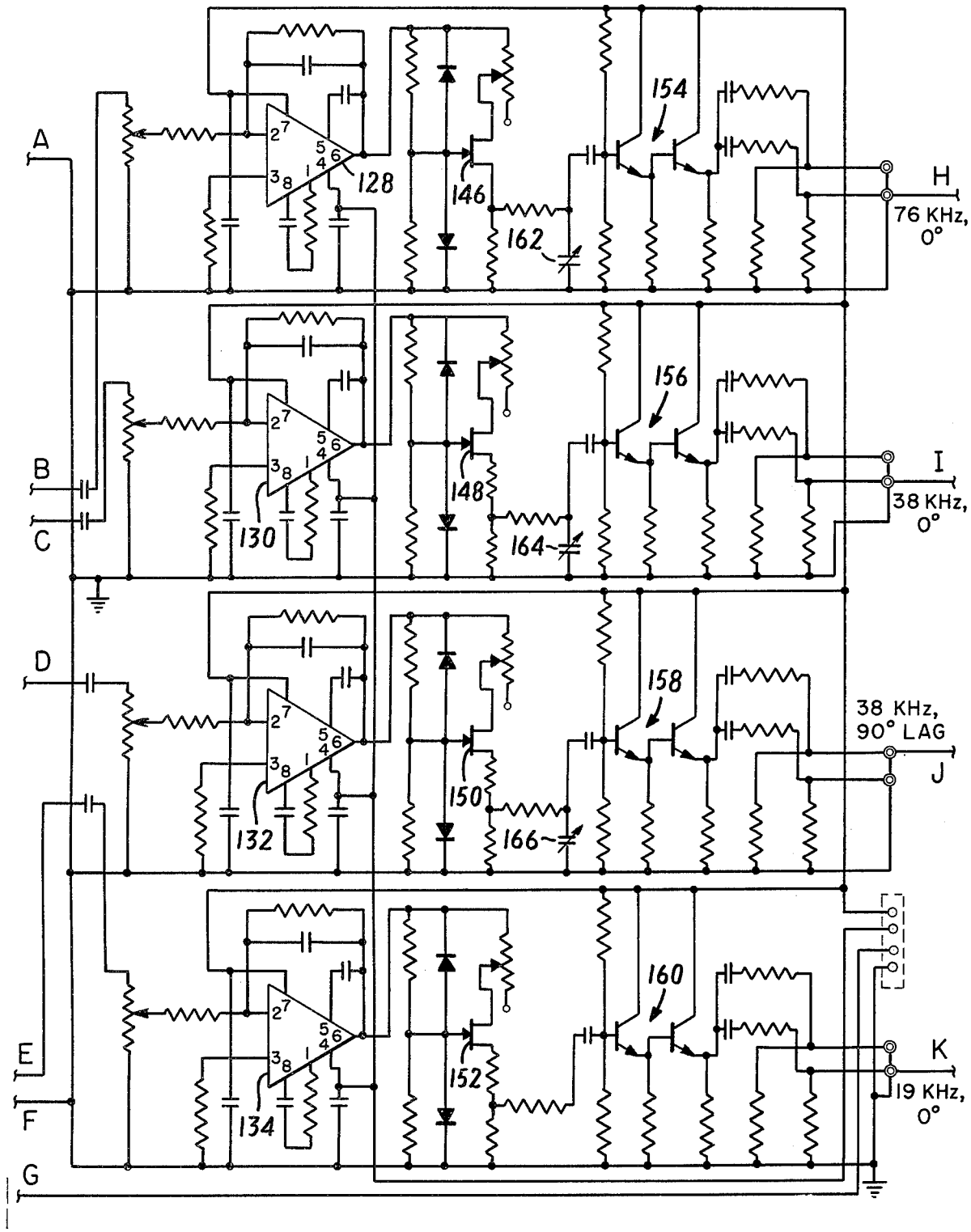

A broadcast system capable of transmitting and receiving a frequency modulated main carrier wave containing four discrete stereophonically related audio frequency inputs includes a transmitter 20 and a receiver 22 shown in the accompanying FIG. 2. The four audio inputs are supplied by four microphones 24 which pick up sound from four parts of an area in which music or other broadcast material is presented. Of course, the inputs could be generated by any of a number of well known playback apparatus adapted to regenerate four prerecorded inputs. The audio inputs from one side of the area in which they originate are designated $L_F$ and $L_R$ for Left Front and Left Rear. The other two inputs are designated $R_F$ and $R_R$ for Right Front and Right Rear. Thus, the two left signals, $L_F$ and $L_R$, may be thought of as corresponding to the left input of a conventional two channel stereophonic system, and the two right inputs, are $R_F$ and $R_R$, may be thought of as corresponding to the right input of a conventional two channel stereophonic system.

A main carrier wave is frequency modulated within the transmitter 20 and disseminated by a transmitter antenna 26. This broadcast signal produces potential differences between portions of a receiver antenna 28 connected to the receiver 22. Four discrete inputs are then reproduced from the broadcast signal by the receiver 22 and applied to four loudspeakers 30 which are arranged in a manner similar to the microphones 24 to recreate the broadcast material for a centrally located listener 32.

Figure 1:
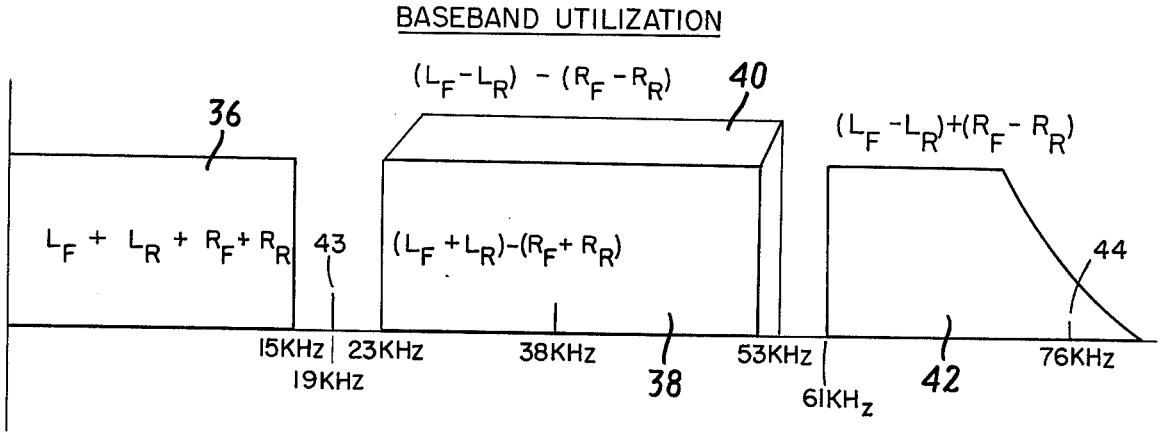
FIG. 1 is a diagrammatic representation of the baseband utilization of the composite signal used to modulate a main carrier wave transmitted and received in accordance with the invention.

The information needed to reproduce the four discrete audio frequency inputs is included in the broadcast signal in such a manner that all the frequencies with which the main carrier wave is modulated fall within a frequency band of minimum width, thus minimizing out-of-band radiation. FIG. 1 is a diagrammatic representation of the base band utilization of the composite signal with which the main carrier wave is modulated. The information impressed on the main carrier wave by frequency modulation may be thought of as falling into four separate channels, each of which contains one of the matrix outputs generated in the transmitter 20. The first matrix output falls within a frequency band 36 that extends from 50 Hz to 15,000 Hz and represents the summation of the four audio inputs $L_F$, $L_R$, $R_F$, and $R_R$. Spaced from this first matrix output frequency band 36 is another frequency band 38 which contains two channels, one of which carries the second matrix output which represents $(L_F + L_R) - (R_F + R_R)$ while the other contains the third matrix output which represents $(L_F - L_R) - (R_F - R_R)$. The portion of the frequency band 38 occupied by the third matrix output is represented three dimensionally by the area 40. The frequency band 38, 40 extends from 23 KHz to 53 KHz. It includes the sidebands of a first subcarrier at 38 KHz and a second subcarrier at the same frequency and in quadrature relationship with the first. Another frequency band 42 includes the lower sideband of a depressed or suppressed third subcarrier at 76 KHz which extends to 61 KHz plus a small portion of the upper sideband. This fourth channel includes the fourth matrix output which represents $(L_F - L_R) + (R_F - R_R)$.

The composite signal further includes a pilot signal at 19 KHz which preferably accounts for 8–10% of the total modulation of the main carrier wave. This pilot signal may be used to regenerate the first, second, and third subcarrier waves in the receiver 22 and provides an indication that at least two channels are present.

The third subcarrier at 76 KHz may be suppressed, or it may be depressed to the extent that it accounts for about a 5 percent portion of the total modulation of the subcarrier wave which is included in the main carrier wave. This depressed third subcarrier may be sensed by the receiver 22 and used as a control signal to provide an indication of the presence of four channels.

If the third subcarrier is fully suppressed, the modulation of the main carrier wave within each of the frequency bands 36, 38–40, and 42 equals 90 percent of the maximum possible modulation. The formulae for the matrix output representations are arranged so that the sum of these three modulations will at no time exceed the 90 percent of the maximum possible modulation. If the third subcarrier is not fully suppressed but is, instead, depressed only to the extent that it is allotted 5 percent of the maximum possible modulation of the main carrier wave, the frequency bands 36, 38–40, and 42 may each be allotted 85 percent of the maximum possible modulation.

Another advantage of the matrixing arrangement described above is that it is fully compatible with the monophonic and two channel stereophonic systems presently in use. The first matrix output frequency band 36 is the only portion of the signal that would be detected by an unmodified conventional monophonic receiver, and it includes the summation of all four audio inputs to provide a complete monophonic signal. If $L_F$ plus $L_R$ is made to correspond to the left channel and $R_F$ plus $R_R$ is made to correspond to the right channel of a two channel arrangement, the second channel 38 corresponds to the second channel of the conventional two channel system disclosed in my U.S. Pat. No. 3,122,610. That is, the first two channels provide the sum and difference values of the two conventional stereophonic channels and may be de-matrixed in the conventional manner. The 19 KHz pilot signal has been adopted as an international standard for the transmission of two channel stereophonic signals. Accordingly, this aspect of the present arrangement is also compatible with conventional two channel systems in current use.

An advantage of the band utilization of the broadcast system disclosed here is that it permits SCA (Subsidiary Communications Authorization), which is presently broadcast on a subcarrier (67 KHz), to be broadcast as an addition to four channel stereophonic broadcasting at a relatively low frequency such as 95 KHz which is the fifth harmonic of the 19 KHz pilot 43. If a frequency deviation of, for instance, plus or minus 5 KHz is employed, there should be adequate separation between the frequency band 42 which carries the fourth matrix output and SCA information at 95 KHz.

Still another advantage of the restricted band utilization of the present system is that a relatively narrow band IF filter can be employed in the receiver.

The present system requires, of course, a transmitter 20 and at least one receiver 22 capable of producing and utilizing the composite signal diagrammed in FIG. 1. A signal generator portion of the transmitter 20 is shown schematically in FIGS. *3a*, *3b*, *4a*, *4b*, *5a*, and *5b*. The four discrete stereophonically related audio frequency inputs from the microphones 24 are supplied to a plurality of input terminals 45, 46, 48, and 50, (shown in FIG. *3a*). Input $L_F$ is supplied to the terminals 45 and its intensity is adjusted by three variable resistors 52 arranged in a "T" formation between the terminal 45 and a line 54 which is connected to ground. This is referred to as a signal intensity adjusting circuit 56. The input $L_F$ is next supplied to a conventional low pass filter 58 to remove noise and information above the 15 KHz audio frequency range. The input $L_F$ is then supplied to a conventional 75 microsecond pre-emphasis network 60 and then to a transformer 62 by which the pre-emphasis network 60 is coupled to a Wheatstone bridge 64.

Each of the other inputs $R_F$, $L_R$, and $R_R$ are adjusted, filtered, and pre-emphasized in the same manner as the input $L_F$ and are supplied to coupling transformers 66, 68, and 70, respectively. The input $L_R$ from the coupling transformer 66 is supplied to the Wheatstone bridge 64 where it is combined with the input $L_F$. $L_F$ and $L_R$ are thus added on one side of the bridge 64 to produce $L_F + L_R$ in a line 72, and they are subtracted on the other side of the bridge 64 to produce $L_F - L_R$ in a line 74. The inputs $R_F$ and $R_R$ are supplied from the transformers 68 and 70 to a Wheatstone bridge 76 which is arranged in a manner similar to the bridge 64 to produce $R_F - R_R$ in a line 78 and $R_F + R_R$ in a line 80.

The line 74 is connected to a parallel output amplifier 81 (shown in FIG. *3b*) including three transistors 82, 84, and 86. The line 72 is connected to a Similar parallel output amplifier 87 including three transistors 88, 90, and 92. Similarly, the line 78 is connected to a parallel output amplifier 93 including three transistors 94, 96, and 98, and a line 80 is connected to a parallel output amplifier 99 including three transistors 100, 102, and 104. The outputs of these amplifiers 81, 87, 93, and 99 are connected together to provide the four matrix outputs by which the main carrier wave is to be modulated. Thus a first matrix output, $L_F + L_R + R_F + R_R$, is supplied by a line 106 to an amplifier 108; a second matrix output, $(L_F + L_R) - (R_F + R_R)$, is supplied by a line 110 to an amplifier 112; a third matrix output $(L_F - L_R) - (R_F - R_R)$, is supplied by a line 114 to an amplifier 116; and a fourth matrix output, $(L_F - R_R) + (R_F - R_R)$, is supplied by a line 118 to an amplifier 120. The Wheatstone bridges 64 and 76 plus the amplifiers 81, 87, 93, and 99 provide a matrix means which is responsive to the four audio inputs $L_F$, $L_R$, $F_F$, and $F_R$ for producing four matrix outputs each of which is a function of at least one—and in this preferred embodiment four—of the audio inputs.

FIGS. *4a* and *4b* (which are joined together as indicated by the letters A through G) show the arrangement for generating the subcarrier waves, pilot signal, and control signal which are combined with the output of the amplifiers 108, 112, 116, and 120. A 152, KHz crystal oscillator 122 is supplied with power from a 117 volt 60 Hz source. The output of the oscillator 122 is supplied to two Motorola MC791P Dual J-K Flip-Flops 124 and 126 from which it is supplied after appropriate frequency division and phase shift to four Motorola MC1709C Operational Amplifiers 128, 130, 132, and 134. These integrated circuit components are commercially available and their internal operation is, therefore, not described here.

The output of the flip-flops 124 and 126 is a plurality of square waves, the frequency of which is varied by addition in or out of phase. The operational amplifiers 128, 130, 132, and 134 act as integrators to convert the square waves into sawtooth waves. The output of each operational amplifier is shaped sinusoidally by one of a plurality of field effect transistors 146, 148, 150, and 152. The outputs of these field effect transistors are at 76 KHz, 38 KHz, 38 KHz, and 19 KHz, respectively, The 38 KHz output of the field effect transistor 150 lags the 38 KHz output of the field effect transistor 148 by 90°. The output of the transistor 148 and the output of the transistor 146 are both harmonics of the 19 KHz output of the transistor 152.

The current to the base of the first transistor stage of the amplifiers 154, 156, and 158 is adjusted in each case by one of a plurality of variable capacitors 162, 164, and 166 to provide a phase alignment with the input to the amplifier 160. A variable capacitor need not be provided in association with the amplifier 160 because it is a reference point to which the other branches are adjusted.

The outputs of the circuits shown in FIGS. *3f* and *4f* are supplied to the input terminals 168, 170, 172, 174, 176, 178, 180, and 182 of the circuit shown in FIGS. *5a* and *5b*. The 19 KHz output of the amplifier 160 is supplied by the input terminal 168 to a pilot amplifier 184 to provide the pilot signal.

The level and phase of this pilot signal is adjusted by an adjustable resistor 185 and another adjustable resistor 186, respectively, to equal 10 percent of the maximum modulation of the main carrier wave. The output of the pilot amplifier 184 is added to the first matrix output from amplifier 108 at node 187 and supplied to a preamplifier 188, including a transistor 189, and an impedance matching resistor 190. The output of the preamplifier 188 is applied to a multistage low pass filter and time delay means 191 to which the output of the pilot amplifier 184 is supplied. The output of the filter and time delay means 191 is supplied to a transistor 192 as the first input to a three input adder 194 formed by the transistor 192 and two other transistors 196 and 198.

The 38 KHz output of the amplifier 156 is supplied to the input terminal 172, and the second matrix output from amplifier 112 is supplied to the input terminal 174. These terminals provide the input to a Motorola MC1596G Balanced Modulator - Demodulator 200. A similar balanced modulator 202 is supplied, through input terminals 176 and 178, with the 38 KHz output of the amplifier 158 and the third matrix output from the amplifier 116. Each of the balanced modulators 200 and 202 produces two outputs which are converted to single outputs by adders 204 and 206 respectively. The outputs of the adders 204 and 206 are supplied to another adder 208.

The outputs of amplifiers 156 and 158 together provide first and second quadrature related subcarriers at 38 KHz. The means for generating these subcarriers are the crystal oscillator 122, the operational amplifiers 130 and 132, the field effect transistors 148 and 150, and the amplifiers 156 and 158. The balanced modulators 200 and 202 form a means for modulating this first and second subcarrier waves with the second and third matrix outputs, respectively, from the amplifiers 112 and 116. The first subcarrier taken from the amplifier 158 and supplied to the input terminal 172 leads by 90° the second subcarrier taken from the amplifier 156 and supplied to the terminal 176. The balanced modulators 200 and 202 also form a means for suppressing the first and second subcarriers, respectively. The output of the adder 208 is the sidebands of the modulated first and second subcarrier waves. These are supplied to a 23 to 53 KHz band pass filter 210 and then to a time delay means 212.

The 76 KHz output of the amplifier 154, which forms a third subcarrier, is supplied to the input terminal 180, and the fourth matrix output from the amplifier 120 is supplied to the input terminal 182. These terminals are connected to a balanced modulator 214 which is the same as the aforementioned balanced modulators 200 and 202. The two outputs of the balanced modulator 214 are combined by a differential amplifier formed by a pair of transistors 218 and 220 which, along with the transistor 222, form a limiting means 224 for limiting the modulation of the third subcarrier by the fourth matrix output to a maximum below the highest level otherwise possible. This limiting is accomplished through the transistor 222 which, in accordance with the bias levels established by a variable resistance 225, determines the amplitude of the maximum output of the transistors 218 and 220. The function of this limiting means 224 is to prevent the modulation of the 76 KHz third subcarrier from reaching a level at which out-of-band radiation would become undesirably high. Thus, the limiting means may be a compressor, although the limiter arrangement 224 is preferred. To most effectively accomplish this objective, the maximum modulation should be limited to between 30 and 90 percent of the highest level otherwise obtainable (if no limiting were employed). Considering that the fourth matrix output is equal to $(L_F - L_R) + (R_F - R_R)$, in the absence of limiting it may be appreciated that this highest level would pertain for the condition in which amplitudes of the input signals $L_F$, $L_R$, $R_F$ and $R_R$ are of equal and maximum value, and $L_R$ and $R_R$ are out of phase with $L_F$ and $R_F$, respectively. Limiting to a maximum of approximately 60 percent has been found to be optimum for most purposes. There are, of course, many circuit arrangements which could be employed to limit the modulation of the third subcarrier wave. For instance, it would be possible to limit the fourth matrix output before it is applied to the balanced modulator 214.

The limiting of the third subcarrier does not affect the quality of the sound produced by the system to a significant extent because, due to the definition of the matrix outputs, modulation in accordance with the fourth matrix output would infrequently exceed the maximum to which it is limited, and when limiting does occur it is generally of short duration.

Figure 10:
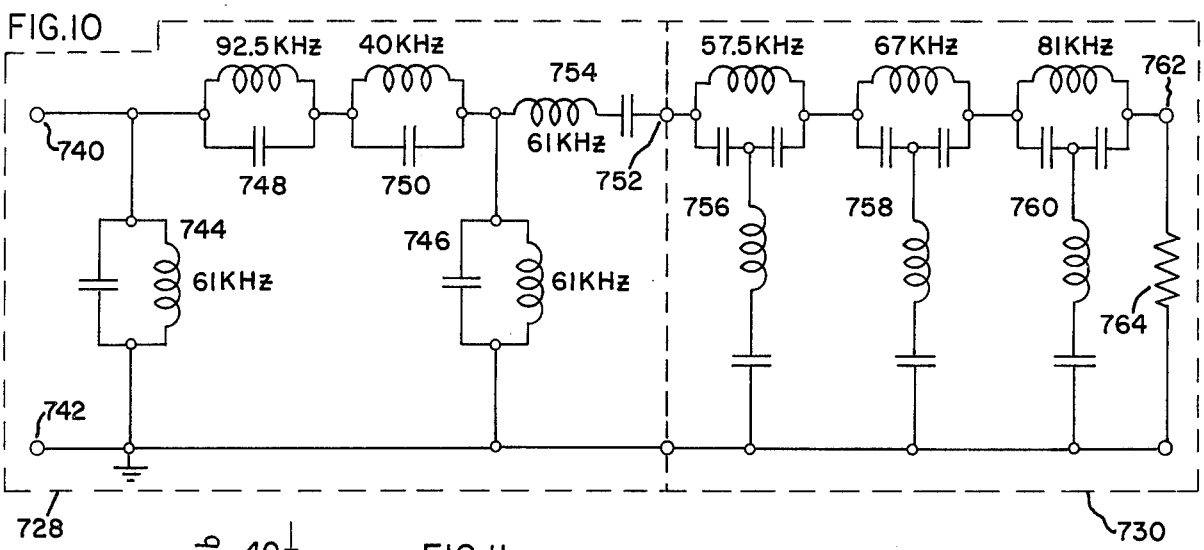
FIG. 10 is a schematic representation of a preferred form of a bandpass filter circuit and time delay equalizer circuit responsive to the modulated third subcarrier wave in the transmitter of FIG. 2.

The output of the limiter 224 is applied to a 46, KHz to 76 KHz band pass filter 228. This filter 228 removes all but a relatively small portion of the upper sideband of the suppressed third subcarrier wave and attenuates the uppermost portion of the lower sideband. To produce the energy distribution shown diagrammatically as frequency band 42 in FIG. 1, it should be noted that although the filter 228 would permit the passage of frequencies as low as 46 KHz, the lower sideband extends only to 61 KHz. A preferred form of the bandpass filter 228 is illustrated in FIG. 10, and will be discussed in greater detail subsequently.

The transmitter 20 may optionally include a means 238 for generating a 76 KHz control signal which is indicative of the present four discrete stereophonically related audio frequency inputs in the composite signals. This control signal generating means 238 is similar to the pilot amplifier 184 and receives a 76 KHz input from a line 240 connected by a switch 248 to a line 242 which in turn connects the terminals 180 to the balanced modulator 214. The output of the control signal generating means 238 is supplied to a line 244 to anode 246 at the output end of the additional time delay means 232. The switch 248 is provided for disconnecting the control signal generating means 238.

Because the four matrix outputs, the 19 KHz pilot signal, and the control signal are, in a sense, added together in the broadcast signal, their phase relationship to each other is critical. If the proper phase relationship is not maintained, cross talk between the channels will result. The plurality of time delay means 191, and 212 lengthens the travel time through the signal generator of the first modulated output and modulated second, and third matrix matrix outputs to equal that of the modulated fourth matrix output which, because of the added complexity of the circuit through which it passes, has the longest travel time. It is, however, preferable to provide a time equalizer means 230, which forms a part of the filter 228. The function of the time equalizer means 230, which is an all pass filter, is to equalize the travel time signals of different frequencies take to pass through the filter means 228 and the equalizer means 230. An additional time delay means 232, is supplied with the output of the equalizer means 230 to provide a finer adjustment of the travel time.

The output of the additional time delay means 232 is supplied to the adder 194, the function of which is to combine the four matrix outputs. The output of the adder 194 is amplified by a transistor 250 and supplied to a conventional exciter.

Figure 5A:
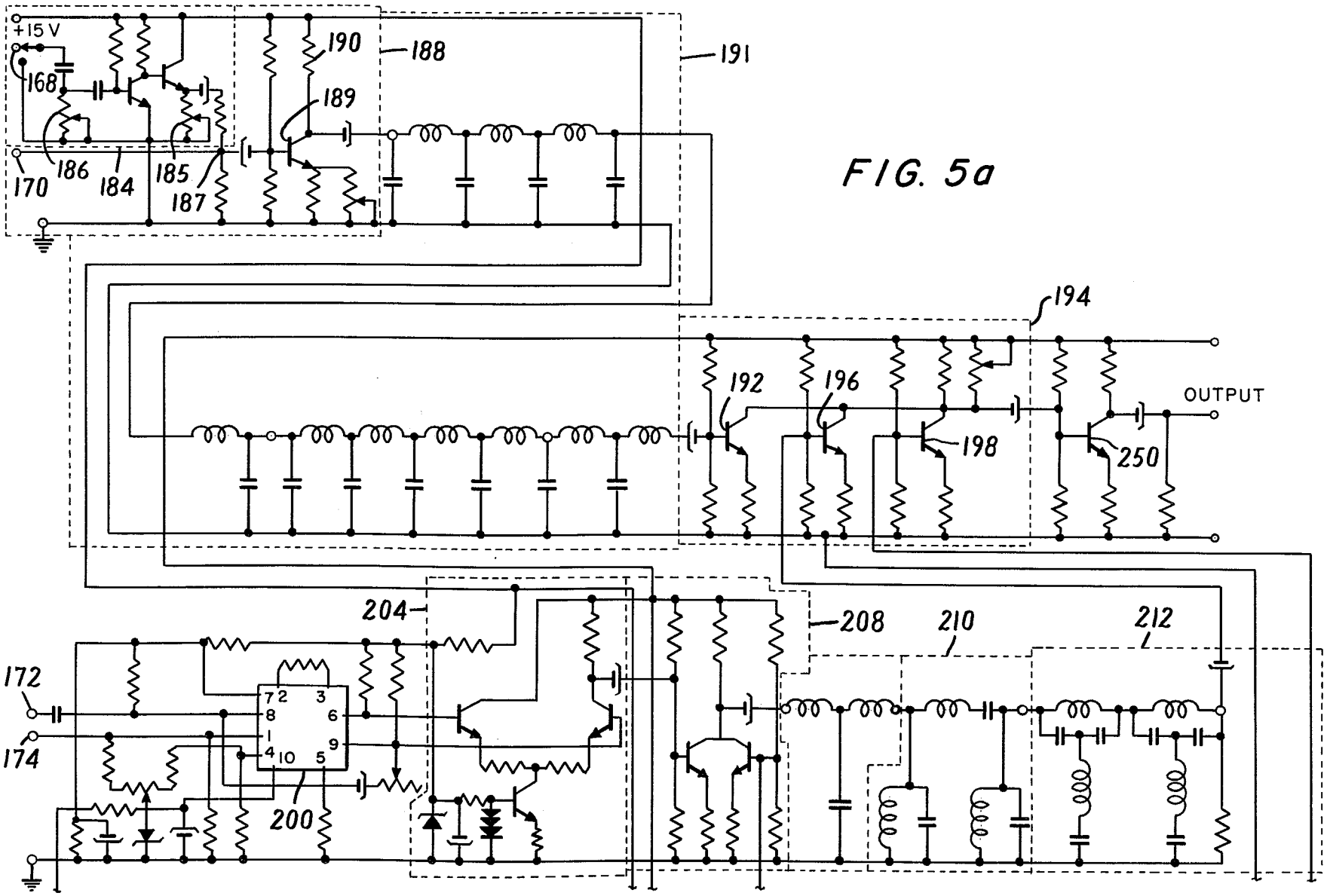
Figure 5B:
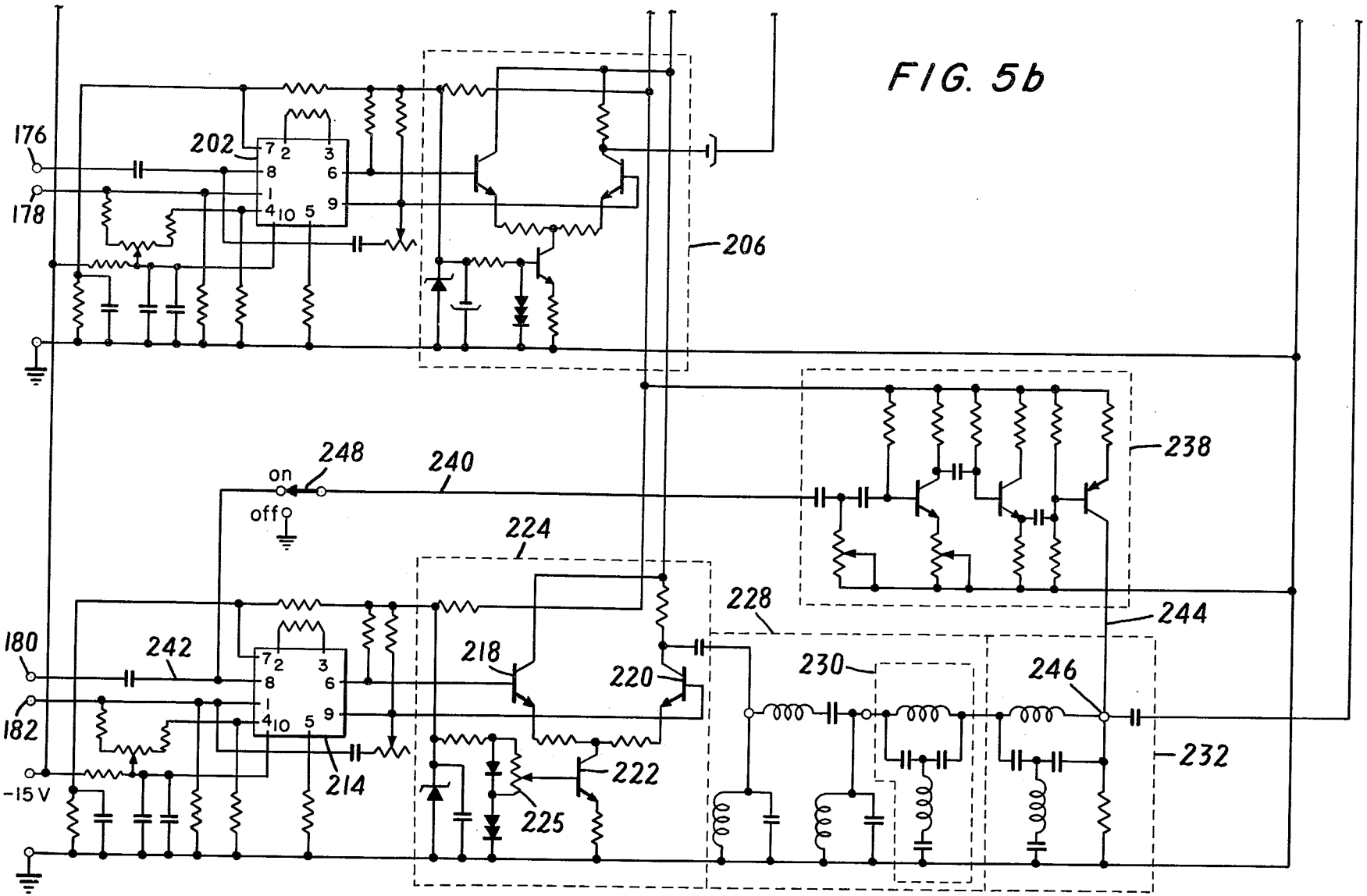
Figure 6:
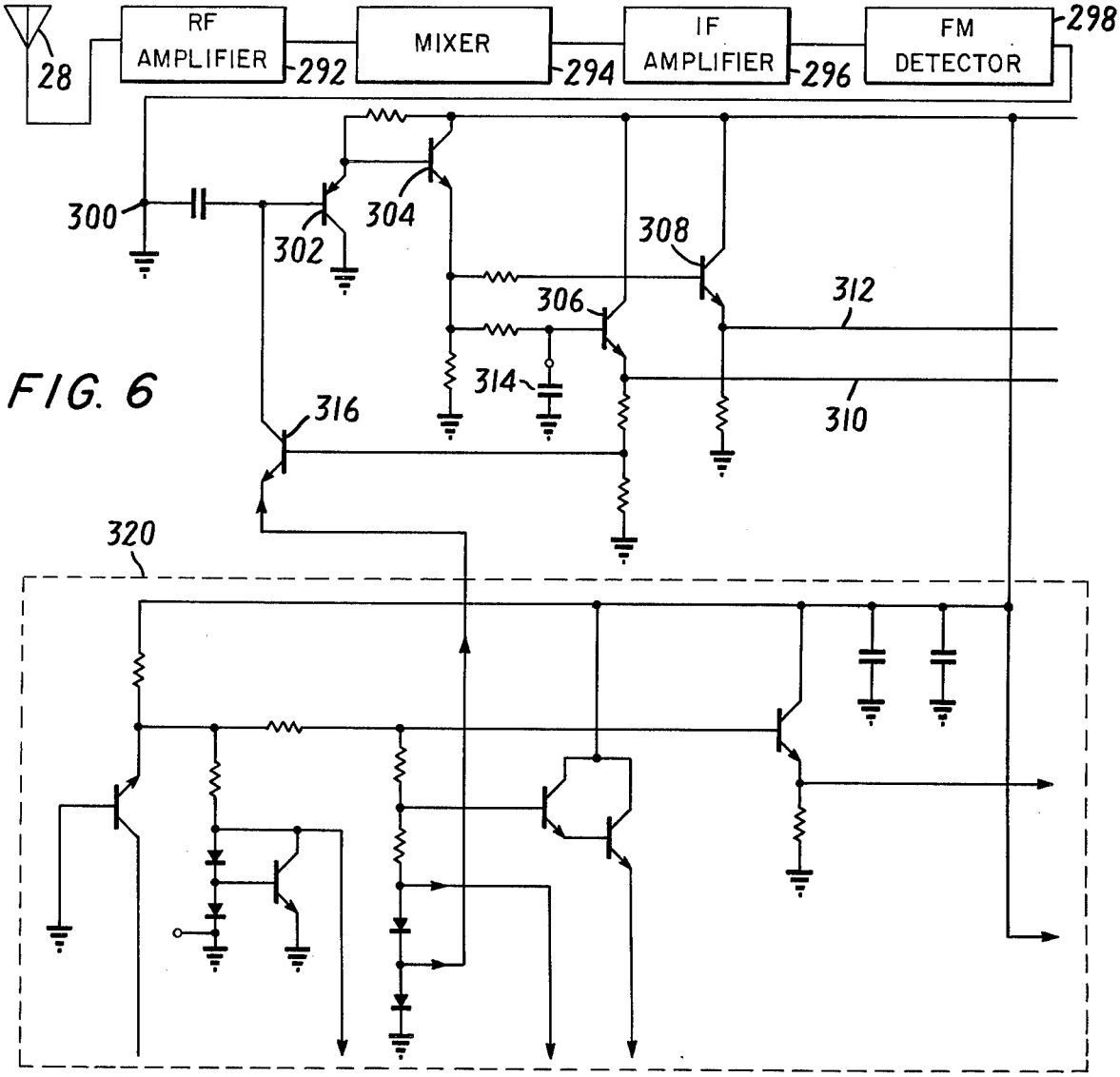
FIGS. 6, 7, 8, and 9 are schematic representations of portions of a receiver that is part of the system of FIG. 2.
Figure 9:
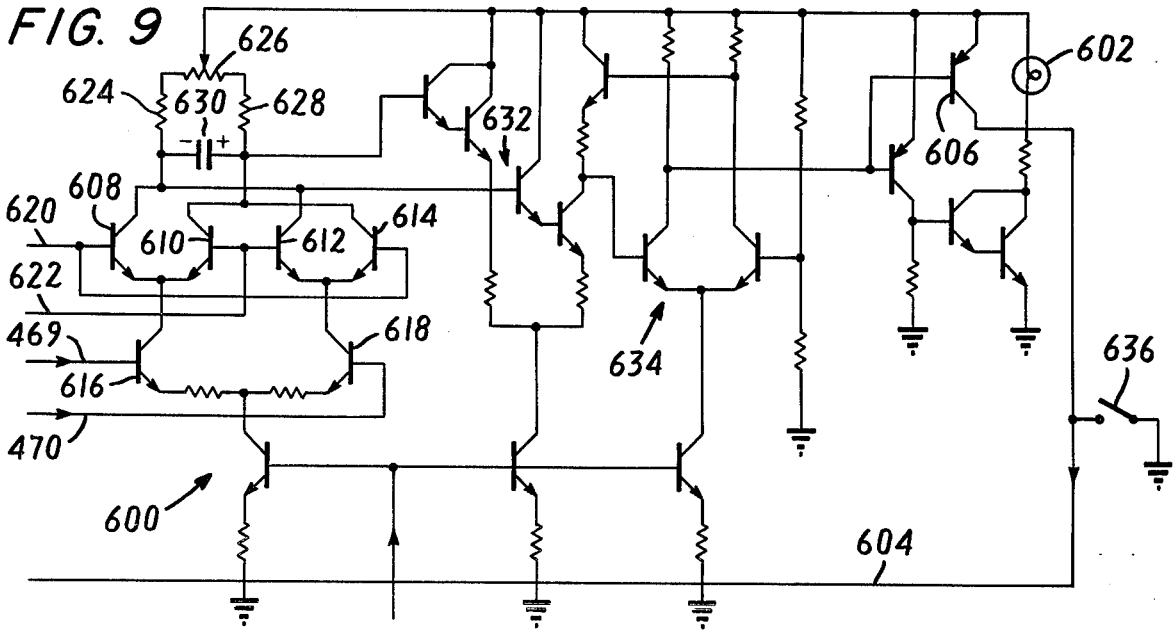
Figure 7:
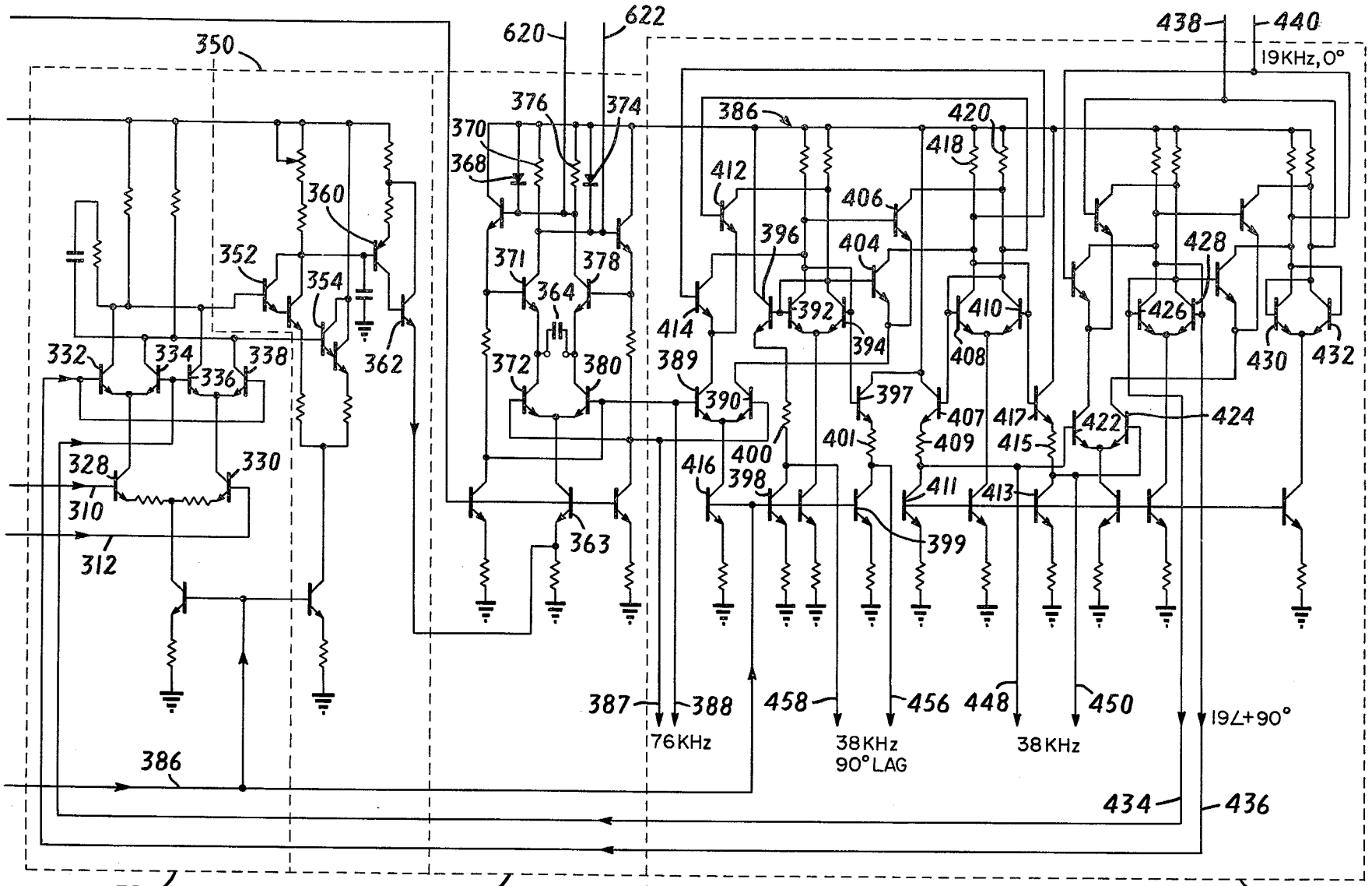

In FIG. 10 there is shown a bandpass filter 728 and a time delay equalizer 730, which are, respectively, preferred configurations of the filter 228 and time delay equalizers 230–232 of FIG. 5*b*. Filter 728 has a pass band extending from approximately 46 KHz to 76 KHz, with a center frequency at 61 KHz, which is the lower edge of the lower sideband of the third subcarrier wave. This is illustrated in the filter attenuation versus frequency characteristic of FIG. 11*a*. As also seen from the filter response characteristic of FIG. 11*a*, the upper skirt is generally linear about the 76 KHz subcarrier frequency, and exhibits an approximately 6 db voltage attenuation at this frequency.

Figure 11A:
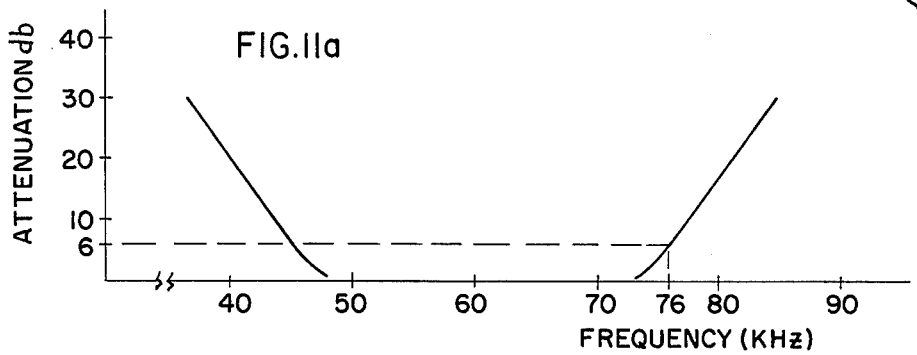
FIGS. 11*a*, 11*b* and 11*c* present several characteristic curves applicable to the filter and equalizer circuits of FIG. 10.

By locating the center frequency at the edge of the lower sideband and having the pass band of the filter extended to approximately twice that of the lower sideband, rather than having the pass band of equivalent width to the lower sideband with a center frequency at the mean frequency of said sideband, i.e., 68.5 KHz, the time delays of the lower modulation frequencies (or higher audio frequencies), which are in the middle of the filter pass band, are relatively constant and small. The variations in time delay occur principally at the higher modulation frequencies (or lower audio frequencies) which are at the edge of the pass band. This is shown by the time delay versus frequency characteristic of the filter 728 of FIG. 11*b*. Variations in the lower audio frequencies are of a less critical nature than variations in the higher audio frequencies. Thus, through the employment of this filter with the noted positioning of the center frequency, time delay euqalization of the diverse frequencies traversing the filter can be more readily and completely achieved than would otherwise be possible. The equalized time delay characteristic of the filter 728 is illustrated by the curve of FIG. 11*c*.

The upper skirt of the filter response characteristic, exhibiting an approximate 6 db voltage attenuation at the 76 KHz subcarrier frequency, provides for the transmission of both upper and lower sideband components for the lower audio frequencies only, up to about 2–3 KHz. Within this range, corresponding frequencies in the upper and lower sideband components are of inversely related voltage, so that, upon demodulation, they will be summed to be of equal value to the demodulated signals at the higher audio frequencies, which are under the flat portion of the filter response characteristic. This has the advantage of providing a relatively distortion free demodulation of the lower audio frequencies in the receiver, while very appreciably conserving bandwidth by the elimination of all but a small portion of the upper sideband.

The bandpass filter 728 of FIG. 10 is a one and one half section filter comprising a pair of input terminals 740 and 742 with the latter grounded. A first parallel L–C circuit 744 resonant at about 61 KHz is connected between said input terminals. A second parallel L–C circuit 746 also resonant at about 61 KHz is connected at the output side of the filter with one end at ground. A third parallel L–C circuit 748 resonant at about 92.5 KHz and a fourth parallel L–C circuit resonant at about 40 KHz are serially connected between the ungrounded terminals of L–C circuits 744 and 746 and together therewith form a full section bandpass filter. Coupled between the junction of L–C circuits 746 and 750 and an output terminal 752 is a series L-C circuit 754 resonant at about 61 KHz, which together with L–C circuit 746 forms an additional one half section bandpass filter.

The inductor and capacitor component values are selected to give the desired bandpass filter characteristics. In this regard, the parallel L–C circuits 748 and 750 are a pair of M derived filter components which cause the frequency response curve of the filter to exhibit poles at the indicated resonant frequencies, thereby contributing to shaping of the filter skirts. The series L–C circuit 754 is provided for maintaining substantial attenuation for frequencies outside of the poles and, in particular, beyond 92.5 KHz.

Formation of the upper skirt is of particular importance in the filter design for achieving a partial transmission of the lower audio frequencies in both the upper and lower sidebands that makes possible a faithful demodulation of these frequencies in the receiver. As shown in FIG. 11*a*, the upper skirt extends from a zero db point about 2–3 KHz below the 76 KHz subcarrier frequency, having an approximately linear slope with an incremental attenuation of about 2.2 db per KHz so as to pass through the 6 db point at the subcarrier frequency. For the indicated slope, the effective upper edge of the filter pass band is 2–3 KHz above the subcarrier frequency where the attenuation is about 12 db. Accordingly, within this partially attenuated portion of the pass band corresponding audio frequencies in the upper and lower sidebands have inversely related voltages, the sums of which may be considered to be unity and equal to the voltage of the unattenuated higher audio frequencies transmitted only in the lower sideband.

For the above noted relationships to exist exactly, it is necessary that the upper skirt pass through the 6 db point at the subcarrier frequency. Although the 6 db point is optimum, it is believed satisfactory performance can be achieved within a tolerance of approximately $\pm$ 0.5 db. In addition, the slope of the skirt may be somewhat different than the indicated value, being limited on the one hand by the tolerable signal in the upper sideband, and on the other hand by the severity of phase shift introduced into the lower audio frequencies by a sharp cut-off. It is found that within these limits, the slope may have an attenuation increment of 2 to 2.5 db per KHz. With respect to this discussion, the bandpass characteristic of the described filter provides the ideal compromise between a single sideband transmission, which requires minimum bandwidth but has excessive phase shift introduced into the lower audio frequencies that causes considerable distortion, and a double sideband transmission, which is relatively free of phase shift distortion but requires maximum bandwidth.

Figure 11B:
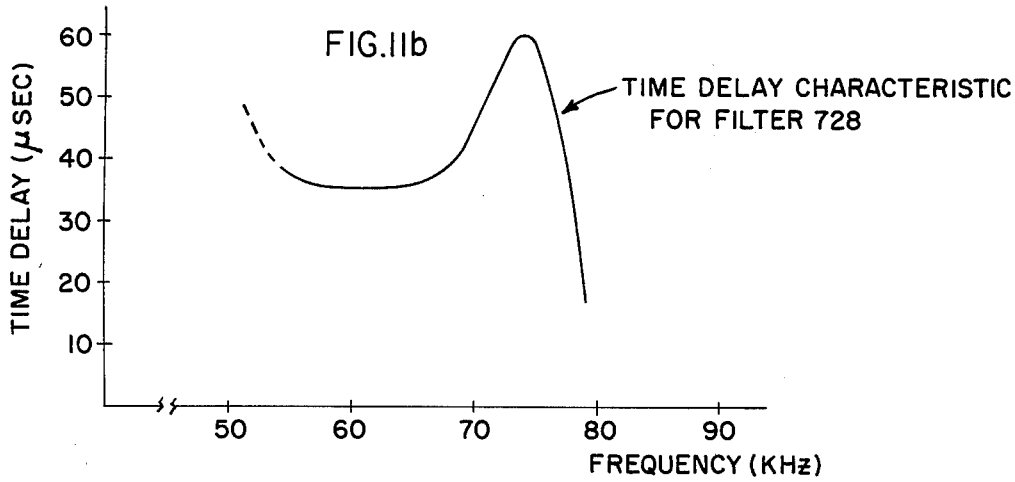
Figure 11C:
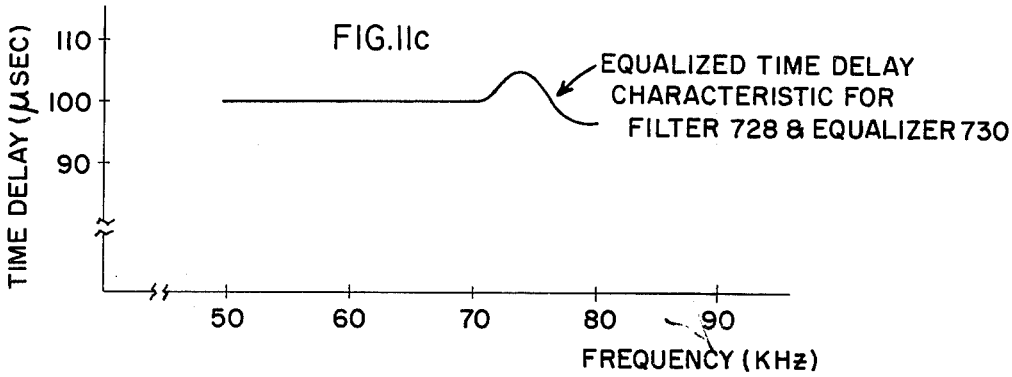

In regard to phase shift properties of the bandpass filter 728, reference is made to the time delay versus frequency curve of FIG. 11*b*. This curve shows the time delay to be relatively constant, at about 35 microseconds, in the middle range frequencies of the pass band and to be variable at the edge of the pass band, increasing to 60 microseconds and then falling to below 20 microseconds. Differences in time delay between the modulation frequencies and subcarrier frequency introduce phase shift distortion. This time delay difference may be appreciated to be less critical in the lower audio frequencies than the higher audio frequencies because a given time delay represents greater phase shift at the higher frequencies. Thus, by employing a bandpass filter with a center frequency at about the lower edge of the lower sideband, time delays of the higher audio frequencies which are in the central portion of the pass band are inherently equalized, and it is only the less critical lower audio frequencies that primarily require equalization, as provided by time delay equalizer 730.

Referring again to FIG. 10, equalizer 730 is an all pass network comprising three bridged T stages 756, 758 and 760 connected in tandem to the output of filter 728. Each bridged T stage is composed of a parallel L-C circuit resonant at a given frequency and having split capacitors, the junction of which is connected by a series L-C circuit to ground. The parallel L-C circuits of stages 756, 758 and 760 are themselves serially connected between terminal 752 and an output terminal 762. A load resistor 764 is shown connected between terminal 762 and ground.

As illustrated in FIG. 11*c*, the time delay equalizer 730 equalizes the overall time delay interposed by the combined networks 728 and 730. Thus, the time delay is made relatively constant at a given amount of delay, shown to be 100 microseconds, for the higher and intermediate audio frequencies of the lower sideband, and varies by only several microseconds for the lower audio frequencies. Of particular significance, the time delay at the 76 KHz subcarrier frequency is equated to the amount of the constant delay so that minimal phase distortion is introduced at the higher and intermediate audio frequencies. In addition, the differences in time delays at the lower audio frequencies with said constant delay are insufficient to introduce more than minimal phase distortion at the lower audio frequencies. For example, considering as a worst case a time delay of 105 microseconds at 3 KHz, which represents a difference in time delay with that of the subcarrier wave of 5 microseconds, there is introduced a phase shift of about 5° in the 3 KHz audio signal, which is well within tolerable limits.

It is noted that the time delay equalizer 730 selectively adds time delay to that of the filter 728 so as to provide the noted equalization. In this respect it is not the amount of time delay for the overall circuit that is of significance, but rather the invariant nature of this amount over the band of frequencies that are passed, for reasons above considered. With a relatively constant amount of time delay in the fourth channel, the time delays in the remaining three channels are readily adjusted to equal this amount.

The receiver 22 designed to utilize the frequency modulated main carrier wave produced by the transmitter 20 is shown schematically in FIGS. 6, 7, 8, and 9. This receiver 22 includes a conventional antenna 28, a radio frequency amplifier 292, a mixer 294, an intermediate frequency amplifier 296, and an FM detector 298 as well as the circuitry shown and described in detail here. It must regenerate the first, second, and third subcarrier waves, detect the four matrix outputs, and de-matrix the four matrix outputs to reproduce the four discrete audio frequency inputs which are supplied, through conventional amplifiers, to the speakers 30. The receiver 22 described here is well suited for performing these functions, but, like the transmitter 20, the receiver 22 may be modified in many ways within the concept of the invention and still perform these functions adequately. However, the receiver 22 is part of the broadcast system and must be specifically designed to utilize the composite signal produced by the cooperating transmitter 20.

The portion of the preferred receiver 22 shown in FIGS. 6, 7, 8, and 9 is of an integrated circuit design and detects the four matrix outputs by time division of the composite signal. These features of the receiver 22 are not absolutely essential and the four matrix outputs could be detected by more conventional tuned circuits. Such an arrangement, however, does not offer many of the advantages of inductorless integrated circuitry which lends itself to the time division technique.

The signal from the FM detector 298 is applied to an input terminal 300 and passes through an amplifier (shown in FIG. 6) including transistors 302, 304, 306, and 308 by which two separate signal channels are developed. This configuration provides a signal readily utilized by the integrated circuitry to follow. A DC output is taken from the transistor 306 by a line 310, and an AC output plus the DC output is taken from the transistor 308 by a line 312. Undesired AC components are removed from the signal before it reaches the base of the transistor 306 by a capacitor 314.

A bias voltage generating section 320 (shown in FIG. 6), which is a conventional arrangement, is utilized to provide the voltage levels required by various portions of the integrated circuit which are described below.

The lines 310, and 312 supply the signal to a guadrature detector 326 (shown in FIG. 7) where it is applied to the bases of two transistors 328 and 330 which form a differential amplifier. This amplifier is connected to, and drives the emitters of two pairs of transistors 332 and 334, 336 and 338 which form a double-pole, double-throw switch. The state of this switch is determined by a frequency divider 346. The detector 326, a current controlled oscillator 348, a DC amplifier 350, and the frequency divider 346 form a phase locked loop.

The output of the detector 326 is applied to the base of transistors 352 and 354 which form a DC differential amplifier 350. The output of this amplifier 350 is converted from a voltage signal to a current signal by two transistors 360 and 362 and then supplied to the current controlled oscillator 348 at the emitter of a transistor 363.

The oscillator 348 is an emitter coupled astable multi-vibrator modified so that the charging current through a capacitor 364, which is external to the integrated circuitry, is a function of the signal current applied through the transistor 363. This current flows through a diode 368 and a parallel load resistor 376, a transistor 378, the capacitor 364, and a transistor 372. Alternatively, the current may flow through a diode 374 and a parallel load resistor 370, a transistor 371, the capacitor 364, and a transistor 380. The transistors 372 and 380 form a differential current switch which is responsive to the differential voltage across the collectors of the transistors 371 and 378. The transistors 371 and 378 have cross coupled collectors and bases to provide the positive feedback required for astable operation. The voltage bias for the transistors of the current controlled oscillator 348 is provided by a line 386 from the bias voltage generation section 320. The free running frequency of the oscillator 348 is determined by capacitor 364 and the collector current of transistor 363.

The output of the voltage controlled oscillator 348 taken from the bases of the transistors 372 and 380 is a square wave at 76 KHz supplied to a pair of terminals 387 and 388. This becomes the input to the frequency divider 346. The frequency divider 346 comprises two modified, current mode logic, master-slave flip-flops. The first master-slave flip-flop, comprising a pair of transistors 392, 394, and a pair of transistors 408, 410, is clocked from the 76 KHz oscillator 348 and produces two 38 KHz signals which are in phase quadrature, thus regenerating the first and second subcarrier waves. The first 38 KHz subcarrier is taken from a pair of output lines 448 and 450. The second subcarrier 38 KHz signal, which lags the first by 90°, is taken from a pair of output lines 458, 456.

A transistor pair 412, 414 forms a gate switch means for gating the master flip-flop 392, 394 and a transistor pair 404, 406 forms a gate switch means for gating the slave flip-flop 408, 410. The outputs from the master flip-flop are shifted in DC level by the transistor resistor networks 396, 398, 400, and 397, 399, 401 which drive the output lines 458, 456.

The DC levels of the outputs of the slave flip-flops are shifted by the transistor and resistor networks 407, 411, 409, and 417, 413, 415 which drive the output lines 448, 450. A transistor pair 389, 390 forms a clock switch means to drive the master-slave flip-flop from the oscillator 348.

The second master-slave flip-flop is clocked by the second 38 KHz signal from the first master-slave flip-flop, and produces two 19 KHz signals which are in phase quadrature. The first 19 KHz signal is taken from a pair of output lines 438, 440. The second 19 KHz signal, which leads the first by 90° is taken from a pair of output lines 434, 436. The operation of the second master-slave flip-flop, including the gate switch means, clock switch means and DC level shift means, is identical to the first master-slave flip-flop. The 19 KHz output is supplied by lines 434 and 436 to the transistors 334 and 332, respectively, of the detector 326 to complete the phase locked loop. A pair of lines 438 and 440 supply the output of the flip-flop 430, 432 to the bases of the transistors 542 and 544, and 540 and 546 of the 19 KHz pilot detector 528 in FIG. 8.

Figure 8:
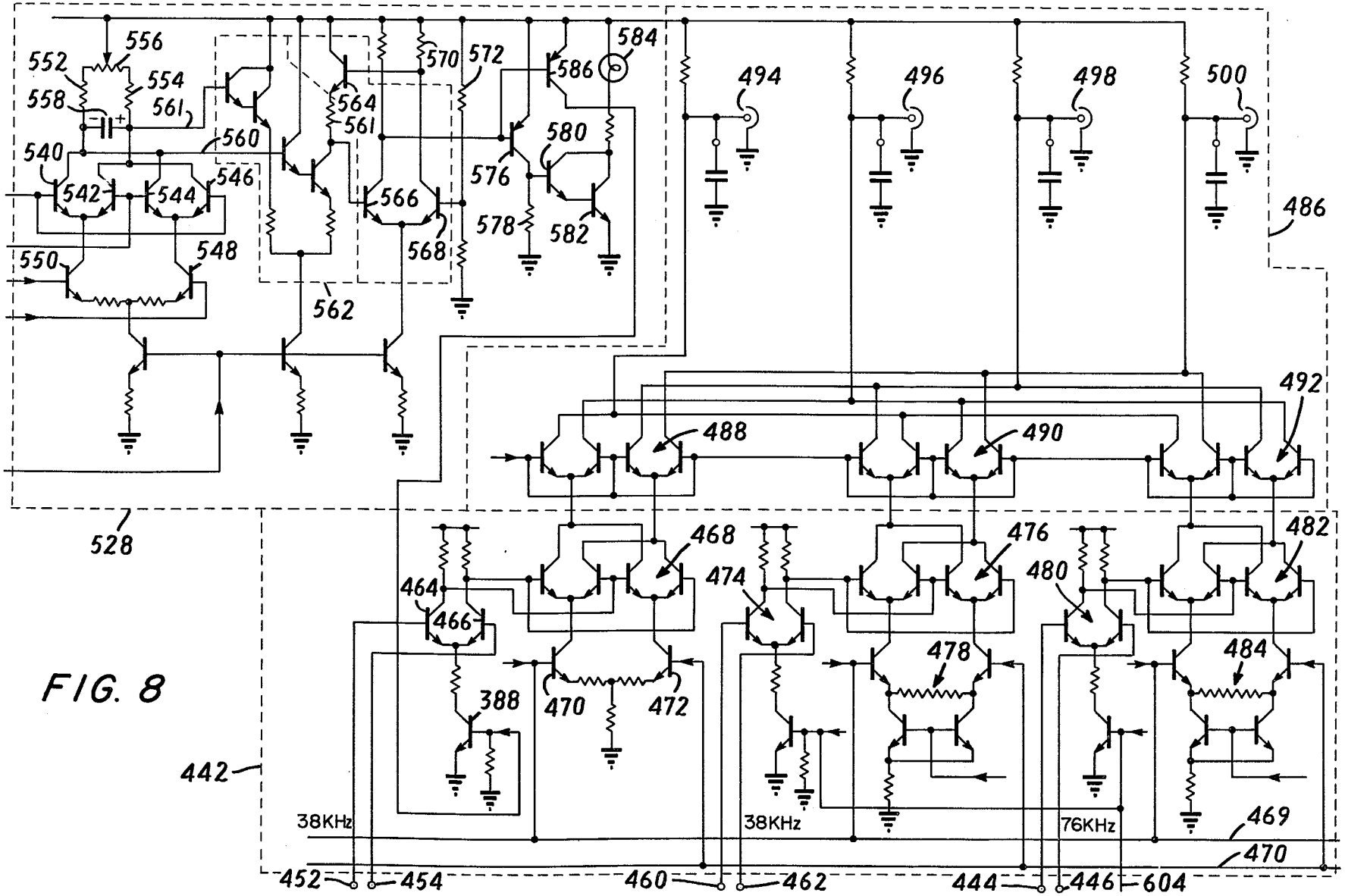

FIG. 8 shows a means 442 for detecting the four matrix outputs. The 76 KHz output of the oscillator 348 is taken from the output terminals 387 and 388 and supplied to a pair of input terminals 444 and 446 at the matrix output detecting means 442. A 38 KHz first subcarrier generated by the flip-flop 408, 410 is taken from a pair of output terminals 448 and 450 of the frequency divider 346 and applied (reinserted) to a pair of input terminals 452 and 454 at the matrix output detector 442. Similarly, the 38 KHz second subcarrier generated by the flip-flop 392, 394, which lags the output of the flip-flop 408, 410 by 90°, is taken from a pair of output terminals 456 and 458 of the frequency divider 346 and applied (reinserted) to a pair of input terminals 460 and 462 at the matrix output detecting means 442. Thus, the current controlled oscillator 348 forms a means for regenerating and reinserting the third subcarrier wave at 76 KHz. The flip-flops 392, 394 and 408, 410 of the frequency divider 346 form a means for regenerating and reinserting the first and second subcarrier waves at 38 KHz.

The 38 KHz signal from the input terminals 452 and 454 is applied to a gate comprising transistors 464 and 466 which operates a four transistor double-pole, double-throw switch 468 to control the time division sampling of the composite signal which is applied by two lines 469 and 470 to the bases of two transistors 470 and 472 which form a differential amplifier. In a similar manner, the lagging 38 KHz signal from the input terminals 460 and 462 is applied to a gate 474 which operates a double-pole, double-throw switch 476 to control sampling of the signal applied to a differential amplifier 478. A gate 480 receives the 76 KHz input from the terminals 444 and 446 to operate a double-pole, double-throw switch 482 which controls sampling by a differential amplifier 484. In this manner the signal is sampled at the appropriate times to yield the four matrix outputs as outputs of the switches 468, 476, and 482. The switch outputs are applied to a de-matrix means 486 which consists of four transistors 488 which divide each of the outputs of the switch 468 into two outputs, four transistors 490 which divide each of the two outputs of the transistors 476 into two outputs, and four transistors 492 which divide each of the switch 482 into two outputs. The outputs of the transistors 488, 490, and 492 are connected together to add and subtract the matrix outputs yielding the original four audio frequency inputs $L_F$, $L_R$, $R_F$, $R_R$ at four output terminals 494, 496, 498, and 500.

The receiver 22 further comprises a means 528 (shown in FIG. 8) for detecting the presence of the 19 KHz pilot signal 43 which includes four transistors 540, 542, 544, and 546 arranged to form a double-pole, double-throw switch for sampling the signal which is applied by lines 310 and 312 to the bases of a differential amplifier 548, 550. The switches are operated at a 19 KHz rate by the 19 KHz signal from the frequency divider 346, and, as a result, the 19 KHz pilot signal in the composite signal is detected, and a DC voltage proportional to the 19 KHz pilot amplitude is produced across two resistors 552 and 554 and a variable resistor 556. A capacitor 558 filters the AC signal across these resistors. The resistors 552, 554, and 556 as well as the capacitor 558 are external components with respect to the integrated circuitry of the receiver 22.

The voltage drop across the arrangement of the resistors 552, 554, and 556 and the capacitor 558 is proportional to the amplitude of the 19 KHz pilot signal 43. This voltage drop is applied to a differential DC amplifier 562 and then to a differential amplifier 564 which includes a pair of transistors 566 and 568. The transistor 568 has a fixed voltage level applied to its base by a resistor-divider 570, 572. Thus, if the level of the pilot 43 in the composite signal, as amplified by the detector 528 and DC amplifier 562 is higher than the threshold determined by the resistor-divider 570, 572, the transistor 566 is turned on and the transistor 568 is turned off by the regenerative action of a transistor 564 connecting the collector of the transistor 568 to the base of the transistor 566 through resistor 561. When the transistor 568 is turned off, the voltage level at its collector rises, increasing the voltage level applied as a regenerative feedback to the base of the transistor 566 which is thus maintained in a turned on condition.

The conduction of the transistor 566 causes a current to flow to the base of a transistor 576 which then develops a voltage across a resistor 578 and forward biases a transistor 580 and another transistor 582. The transistor 582 drives a lamp 584 to provide a display which indicates that a 19 KHz pilot is being received which is of sufficient strength to reproduce two stereophonic channels.

The current which forward biases the transistor 576 also forward biases a transistor 586, and the collector current from this transistor is supplied to a transistor 388 which disconnects the appropriate portion of the receiver 22 (the flip-flop 464, 466) by becoming non-conductive if the pilot signal level is not sufficiently high for two channel reception.

The receiver 22 optionally includes a switching means 600 (shown in FIG. 9) which is responsive to the presence of a control signal 44 at 76 KHz in the composite signal. A function of the switching means 600 is to provide a display, by a lamp 602, that indicates the presence of four audio frequency inputs. The switching means 600 is also arranged to disconnect a portion of the receiver 22 in the matrix output detector 442 when the indicator signal 44 is not present. This portion of the receiver 22 is the amplifier 484 controlled by the gate 480, which detects the fourth matrix output and the amplifier 478 controlled by the gate 474 which detects the third matrix output. The control signals to the gates 480 and 474 are provided by a line 604 connected to the collector of a transistor 606. The switching means 600 is similar to the 19 KHz pilot detector 528 (shown in FIG. 8), and the transistor 606 and the lamp 602 are operated in the same manner as the transistor 586 and the lamp 584. The lamp 602 is lit and the transistor 606 is turned on only if the 76 KHz control signal has sufficient amplitude to indicate that four audio inputs can be derived from the composite signal. A switch 636 is provided for connecting the line 604 to ground whereby the amplifiers 478 and 484 can be disconnected manually.

The switching means 600 is, of course, useful only if the depressed 76 KHz third subcarrier is not suppressed, but is only depressed and a part thereof is transmitted to provide a control signal.

The broadcast system described above provides for the transmission of a broadcast signal including four discrete stereophonically related audio frequency inputs. This signal substantially meets the presently established Federal Communications Commission standards for FM broadcast and is fully compatible with existing monophonic and two channel stereophonic equipment.

It will be obvious to those skilled in the art that the embodiment described above is meant to be merely exemplary and that it is susceptible of modification and variation without departing from the spirit and scope of the invention. The invention is not deemed to be limited except as defined by the appended claims.

I claim:

1. A system capable of transmitting and receiving a broadcast signal containing four discrete stereophonically related audio frequency inputs including a transmitter and one or more receivers, wherein the transmitter comprises matrix means responsive to said four inputs for producing four matrix outputs each of which is a function of at least one of said inputs, means for generating a main carrier wave, means for frequency modulating the main carrier wave with the first matrix output, means for generating a first subcarrier wave, means for amplitude modulating the first subcarrier wave with the second matrix output, means for generating a second subcarrier wave at the same frequency as the first subcarrier wave and in quadrature relationship with the first subcarrier wave, means for amplitude modulating the second subcarrier wave with the third matrix output, means for suppressing the first and second subcarrier waves, means for frequency modulating the main carrier wave with the sidebands of the modulated first and second subcarrier waves, the frequency of the first and second subcarrier waves being such that there is a gap between the lower sidebands of the first and second subcarrier waves and the frequency band of the first matrix output, means for generating a pilot signal at a frequency that falls within said gap, means for frequency modulating said main carrier wave with the pilot signal, means for generating a third subcarrier wave at a frequency above that of the first and second subcarrier waves, means for amplitude modulating the third subcarrier wave in accordance with the fourth matrix output, means for depressing or suppressing the third subcarrier wave, means for reducing the amplitude of the modulation of the third subcarrier wave to a maximum level below the highest level that would exist in the absence of such a reducing operation, filter means for removing all but a relatively small portion of the upper sideband of the third subcarrier wave and for attenuating the uppermost portion of the lower sideband of the third subcarrier wave, a time equalizer means for equalizing the travel time of signals of different frequencies that pass through the filter means, and means for frequency modulating the main carrier wave with the remaining portions of the sidebands of the modulated third subcarrier wave, the frequency of the third subcarrier wave being such that the lower sideband of the third subcarrier wave is separated from the upper sidebands of the first and second subcarrier waves; and each receiver comprises means responsive to the pilot signal for regenerating and reinserting the first, second, and third subcarrier waves, means for detecting the four matrix outputs, and de-matrix means responsive to the four matrix outputs for reproducing said four discrete audio frequency inputs.

2. The system of claim 1 further comprising a plurality of time delay means in the transmitter for equalizing the travel time of the portions of the composite signal that include each matrix output.

3. The system of claim 1 wherein the first matrix output is representative of the sum of the four audio frequency inputs.

4. The system of claim 1 wherein, assuming that the four discrete audio frequency inputs are represented by the symbols $L_F$, $L_R$, $R_F$, and $R_R$, the four matrix outputs represent functions of these inputs as follows:

the first matrix output represents $L_F + L_R + R_F + R_R$;

the second matrix output represents $(L_F + L_R) - (R_F + R_R)$;

the third matrix output represents $(L_F - {}_{LR}) - (R_F - R_R)$; and the fourth matrix output represents $(L_F - L_R) + (R_F - R_R)$.

5. The system of claim 1 wherein the amplitude reducing means reduces the modulation of the third subcarrier waves to a maximum level which lies between 30 and 90 percent of said highest level.

6. The system of claim 1 wherein the amplitude reducing means reduces the modulation of the third subcarrier wave to a maximum level of approximately 60 percent of said highest level.

7. The system of claim 1 wherein the transmitter further comprises means for generating a control signal having the same frequency as the third subcarrier wave which is indicative of the presence of four discrete stereophonically related audio frequency inputs in the composite signal and the receiver further comprises switching means responsive to the presence of the control signal for disconnecting a portion of the receiver when the control signal is not present.

8. The system of claim 1 wherein the transmitter further comprises means for generating a control signal having the same frequency as the third subcarrier wave which is indicative of the presence of four discrete stereophonically related audio frequency inputs in the composite signal and the receiver further comprises switching means responsive to the presence of the control signal for providing a display that indicates the presence of four audio frequency inputs.

9. The system of claim 1 wherein the frequencies of the first, second, and third subcarriers waves are multiples of the pilot signal frequency.

10. The system of claim 1 wherein the filter means introduces a time delay which varies with the frequency of the signal and wherein the time equalization means introduces a time delay which varies with the frequency of the signal in a manner that compensates for the effect of variations in time delay introduced by the filter means, whereby the total time delay to which signals of various frequencies are subjected by the filter means and the time equalization means together is equal.

11. A transmitter capable of broadcasting a broadcast signal including the information needed to reproduce four discrete stereophonically related audio frequency inputs comprising matrix means responsive to said four inputs for producing four matrix outputs each of which is a function of at least one of said inputs, means for generating a main carrier wave, means for frequency modulating the main carrier wave with the first matrix output, means for generating a first subcarrier wave, means for amplitude modulating the first subcarrier wave with the second matrix output, means for generating a second subcarrier wave at the same frequency as the first and in quadrature relationship with the first subcarrier, means for amplitude modulating the second subcarrier wave with the third matrix output, means for suppressing the first and second subcarrier waves, means for frequency modulating the main carrier wave with the sidebands of the modulated first and second subcarrier waves, the frequency of the first and second subcarrier waves being such that there is a gap between the lower sidebands of the first and second subcarrier waveses and the frequency band of the first matrix output, means for generating a pilot signal at a frequency that falls within said gap, means for frequency modulating the main carrier wave with the pilot signal, means for generating a third subcarrier wave at a frequency above that of the first and second subcarrier waves, means for amplitude modulating the third subcarrier wave with the fourth matrix output, means for suppressing or depressing the second subcarrier wave, means for reducing the amplitude of the modulation of the third subcarrier wave to a maximum level below the highest level that would exist in the absence of such a reducing operation, filter means for removing all but a relatively small portion of the upper sideband of the third subcarrier wave and for attenuating the uppermost portion of the lower sideband of the third subcarrier wave, an equalizer means for equalizing the travel time of signals of different frequencies that pass through the filter means, and means for frequency modulating the main carrier wave in accordance with the remaining portions of the sidebands of the modulated third subcarrier wave, the frequency of the third subcarrier wave being such that the lower sideband of the third subcarrier wave is separated from the upper sidebands of the first and second subcarrier waves.

12. The transmitter of claim 11 wherein the amplitude reducing means reduces the modulation of the fourth matrix output to a maximum level which lies between 30 and 90 percent of said highest level.

13. The transmitter of claim 11 further comprising a plurality of time delay means in the transmitter for equalizing the travel time of the portion of the composite signal that includes each matrix output.

14. A method of transmitting and receiving a broadcast signal including four discrete stereophonically related inputs comprising generating four matrix outputs each of which is a function of at least one of the audio frequency inputs, generating a main carrier wave, frequency modulating the main carrier wave with the first matrix output, generating a first subcarrier wave, amplitude modulating the first subcarrier wave with the second matrix output, generating a second subcarrier wave at the same frequency as the first subcarrier wave and in quadrature relationship with the first carrier wave, amplitude modulating the second subcarrier wave with the third matrix output, suppressing the first and second subcarrier waves, frequency modulating the main carrier wave with the sidebands of the modulated first and second subcarrier waves, the frequency of the first and second subcarrier waves being such that there is a gap between the lower sidebands of the first and second subcarrier waves and the frequency band of the first matrix output, generating a pilot signal at a frequency that falls within said gap, frequency modulating the main carrier wave with the pilot signal, generating a third subcarrier wave at a frequency above that of the first and second subcarrier waves, amplitude modulating the third subcarrier wave with the fourth matrix output, depressing or suppressing the third subcarrier wave, reducing the amplitude of the modulation of the third subcarrier wave to a maximum level below the highest level that would exist in the absence of such an amplitude reducing operation, removing all but a relatively small portion of the upper sideband of the third subcarrier wave, attenuating the uppermost portion of the lower sideband of the third subcarrier wave, equalizing the travel time of portions of the third subcarrier sidebands that are of different frequencies, frequency modulating the main carrier wave with the remaining portions of the sidebands of the modulated third subcarrier wave, the frequency of the third subcarrier wave being such that the lower sideband of the third subcarrier wave is separated from the upper sidebands of the first and second subcarrier waves, propagating the broadcast signal formed by the modulated main carrier wave, sensing the broadcast signal with an antenna, regenerating and reinserting the first, second, and third subcarrier waves by multiplying the frequency of the pilot signal, detecting the four matrix outputs, and reproducing from the four matrix outputs the four discrete audio frequency inputs.

15. The method of claim 14 wherein, assuming that the four discrete audio frequency inputs are represented by the symbols $L_F$, $L_R$, $R_F$, and $R_R$, the four matrix outputs represent functions of these inputs as follows:

the first matrix output represents $(L_F + L_R) + (R_F + R_R)$;

the second matrix output represents $(L_F + L_R) - (R_F + R_R)$;

the third matrix output represents $(L_F - L_R) - (R_F - R_R)$; and the fourth matrix output represents $(L_F - L_R) + (R_F - R_R)$.

16. The method of claim 14 further comprising limiting the amplitude of the modulated third subcarrier wave to a maximum level which lies between 30 and 90 percent of said highest level.

17. The method of claim 14 further comprising equalizing the travel time of the portion of the broadcast signal that includes each matrix output.

18. The method of claim 14 further comprising frequency modulating the main carrier wave with a control signal having the same frequency as the third subcarrier wave, and detecting the control signal to provide an indication of the presence of four discrete stereophonically related audio frequency inputs.

19. A method of transmitting a broadcast signal including four discrete stereophonically related audio frequency inputs comprising generating four matrix outputs each of which is a function of at least one of the audio frequency inputs, generating a main carrier wave, frequency modulating the main carrier wave with the first matrix output, generating a first subcarrier wave, amplitude modulating the first subcarrier wave with the second matrix output, generating a second subcarrier wave at the same frequency as the first subcarrier wave and in quadrature relationship with the first subcarrier wave, amplitude modulating the second subcarrier wave with the third matrix output, suppressing the first and second subcarrier waves, frequency modulating the main carrier wave with the sidebands of the modulated first and second subcarrier waves, the frequency of the first and second subcarrier waves being such that there is a gap between the lower sideband of the first subcarrier wave and the frequency band of the first matrix output, generating a pilot signal at a frequency that falls within said gap, frequency modulating the main carrier wave with the pilot signal, generating a third subcarrier wave at a frequency above that of the first and second subcarrier waves, amplitude modulating the third subcarrier wave with the fourth matrix output, depressing or suppressing the third subcarrier wave, reducing the amplitude of the modulation of the third subcarrier wave to a maximum level below the highest level therefor that would exist in the absence of such a reducing operation, removing all but a relatively small portion of the upper sideband of the third subcarrier wave and attenuating the uppermost portion of the lower sideband of the third subcarrier wave, equalizing the travel time of portions of the third subcarrier sidebands that are of different frequencies, frequency modulating the main carrier wave with the remaining portions of the sidebands of the modulated third subcarrier wave, the frequency of the third subcarrier wave being such that the lower sideband of the third subcarrier wave is separated from the upper sidebands of the first and second subcarrier waves, and propagating the broadcast signal formed by the modulated main carrier wave.

20. A method of receiving a broadcast signal including four discrete stereophonically related audio frequency inputs comprising:

sensing potential differences between portions of an antenna caused by a main carrier wave which is frequency modulated with four matrix outputs each of which is a function of one or more of the audio frequency inputs, the main carrier wave being modulated within a first frequency band by the first matrix output, within a second frequency band by the sidebands of suppressed first and second subcarrier waves at the same frequency and in quadrature relationship with each other that are amplitude modulated with the second and third matrix outputs respectively, within a third frequency band which is of higher frequency than the first frequency band by all but an attenuated uppermost portion of the lower sideband and only a relatively small portion of the upper sideband of a depressed or suppressed third subcarrier that has been amplitude modulated with the fourth matrix output after said fourth matrix output has been reduced in amplitude, and further frequency modulated with a pilot signal of a frequency that falls between the frequency band of the first matrix output and the lower sideband of the first and second subcarriers, regenerating the first, second, and third subcarriers by multiplying the frequency of the pilot signal;

reinserting the first, second, and third subcarriers;

detecting the four matrix outputs; and de-matrixing the four matrix outputs to reproduce the four discrete stereophonically related audio frequency inputs.

21. The method of claim 20 wherein the main carrier wave is also frequency modulated with a control signal having the same frequency as the third subcarrier further comprising detecting the control signal to provide an indication of the presence of four discrete stereophonically related audio frequency signals.

22. A system capable of transmitting and receiving a broadcast signal containing four discrete stereophonically related audio frequency inputs including a transmitter and one or more receivers, wherein the transmitter comprises matrix means responsive to said four inputs for producing four matrix outputs each of which is a function of at least one of said inputs, means for generating a main carrier wave, means for frequency modulating the main carrier wave with the first matrix output, means for generating a first subcarrier wave, means for amplitude modulating the first subcarrier wave with the second matrix output, means for generating a second subcarrier wave at the same frequency as the first subcarrier wave and in quadrature relationship with the first subcarrier wave, means for amplitude modulating the second subcarrier wave with the third matrix output, means for suppressing the first and second subcarrier waves, means for frequency modulating the main carrier wave with the sidebands of the modulated first and second subcarrier waves, the frequency of the first and second subcarrier waves being such that there is a gap between the lower sidebands of the first and second subcarrier waves and the frequency band of the first matrix output, means for generating a pilot signal at a frequency that falls within said gap, means for frequency modulating said main carrier wave with the pilot signal, means for generating a third subcarrier wave at a frequency above that of the first and second subcarrier waves, means for amplitude modulating the third subcarrier wave in accordance with the fourth matrix output, means for depressing or suppressing the third subcarrier wave, filter means for removing all but a relatively small portion of the upper sideband of the third subcarrier wave and for attenuating the uppermost portion of the lower sideband of the third subcarrier wave, said filter means having a center frequency at about the edge of the lower sideband of the third subcarrier wave and an upper skirt that produces a voltage attenuation of about 6 db at the frequency of the third subcarrier wave, a time equalizer means for equalizing the travel time of signals of different frequencies that pass through the filter means, and means for frequency modulating the main carrier wave with the remaining portions of the sidebands of the modulated third subcarrier wave, the frequency of the third subcarrier wave being such that the lower sideband of the third subcarrier wave is separated from the upper sidebands of the first and second subcarrier waves; and each receiver comprises means responsive to the pilot signal for regenerating and reinserting the first, second, and third subcarrier waves, means for detecting the four matrix outputs, and de-matrix means responsive to the four matrix outputs for reproducing said four discrete audio frequency inputs.

23. A system as in claim 22 wherein said filter means is constructed to provide an upper skirt with a generally linear slope about the third subcarrier wave frequency having an incremental value in terms of voltage attenuation of between 2 and 2.5 db per KHz.

24. A system capable of transmitting and receiving a broadcast signal containing four discrete stereophonically related audio frequency inputs including a transmitter and one or more receivers, wherein the transmitter comprises matrix means responsive to said four inputs for producing four matrix outputs each of which is a function of at least one of said inputs, means for generating a main carrier wave, means for frequency modulating the main carrier wave with the first matrix output, means for generating a first subcarrier wave, means for amplitude modulating the first subcarrier wave with the second matrix output, means for generating a second subcarrier wave at the same frequency as the first subcarrier wave and in quadrature relationship with the first subcarrier wave, means for amplitude modulating the second subcarrier wave with the third matrix output, means for suppressing the first and second subcarrier waves, means for frequency modulating the main carrier wave with the sidebands of the modulated first and second subcarrier waves, the frequency of the first and second subcarrier waves being such that there is a gap between the lower sidebands of the first and second subcarrier waves and the frequency band of the first matrix output, means for generating a pilot signal at a frequency that falls within said gap, means for frequency modulating said main carrier wave with the pilot signal, means for generating a third subcarrier wave at a frequency above that of the first and second subcarrier waves, means for amplitude modulating the third subcarrier wave in accordance with the fourth matrix output, means for depressing or suppressing the third subcarrier wave, means for reducing the amplitude of the modulation of the third subcarrier wave to a maximum level below the highest level that would exist in the absence of such an amplitude reducing operation, filter means for removing all but a relatively small portion of the upper sideband of the third subcarrier wave and for attenuating the uppermost portion of the lower sideband of the third subcarrier wave, said filter means having a center frequency at about the edge of the lower sideband of the third subcarrier wave and an upper skirt that produces a voltage attenuation of about 6 db at the frequency of the third subcarrier wave, a time equalizer means for equalizing the travel time of signals of different frequencies that pass through the filter means, and means for frequency modulating the main carrier wave with the remaining portions of the sidebands of the modulated third subcarrier wave, the frequency of the third subcarrier wave being such that the lower sideband of the third subcarrier wave is separated from the upper sidebands of the first and second subcarrier waves; and each receiver comprises means responsive to the pilot signal for regenerating and reinserting the first, second, and third subcarrier waves, means for detecting the four matrix outputs, and de-matrix means responsive to the four matrix outputs for reproducing said four discrete audio frequency inputs.

25. A transmitter capable of broadcasting a frequency modulated main carrier wave including the information needed to reproduce four discrete stereophonically related audio frequency inputs comprising matrix means responsive to said four inputs for producing four matrix outputs each of which is a function of at least one of said inputs, means for generating a main carrier wave, means for frequency modulating the main carrier wave with the first matrix output, means for generating a first subcarrier wave, means for amplitude modulating the first subcarrier wave with the second matrix output, means for generating a second subcarrier wave at the same frequency as the first and in quadrature relationship with the first subcarrier, means for amplitude modulating the second subcarrier wave with the third matrix output, means for surpressing the first and second subcarrier waves, means for frequency modulating the main carrier wave with the sidebands of the modulated first and second subcarrier waves, the frequency of the first and second subcarrier waves being such that there is a gap between the lower sideband of the first subcarrier wave and the modulation of the main carrier wave by the first output means, means for generating a pilot signal at a frequency that falls within said gap, means for frequency modulating the main carrier wave with the pilot signal, means for generating a third subcarrier wave at a frequency above that of the first and second subcarrier waves, means for amplitude modulating the third subcarrier wave with the fourth matrix output, means for suppressing or depressing the second subcarrier wave, filter means for removing all but a relatively small portion of the upper sideband of the third subcarrier wave and for attenuating the uppermost portion of the lower sideband of the third subcarrier wave, said filter means having a center frequency at about the edge of the lower sideband of the third subcarrier wave and an upper skirt that produces a voltage attenuation of about 6 db at the frequency of the third subcarrier wave, an equalizer means for equalizing the travel time of signals of different frequencies that pass through the filter means, and means for frequency modulating the main carrier wave in accordance with the remaining portions of the sidebands of the modulated third subcarrier wave, the frequency of the third subcarrier wave being such that the lower sideband of the third subcarrier wave is separated from the upper sidebands of the first and second subcarrier waves.

26. A system as in claim 25 wherein said filter means is constructed to provide an upper skirt with a generally linear slope about the third subcarrier wave frequency having an incremental value in terms of voltage attenuation of between 2 and 2.5 db per KHz.

27. A transmitter capable of broadcasting a broadcast signal including the information needed to reproduce four discrete stereophonically related audio frequency inputs comprising matrix means responsive to said four inputs for producing four matrix outputs each of which is a function of at least one of said inputs, means for generating a main carrier wave, means for frequency modulating the main carrier wave with the first matrix output, means for generating a first subcarrier wave, means for amplitude for amplitude modulating the first subcarrier wave with the second matrix output, means for generating a second subcarrier wave at the same frequency as the first and in quadrature relationship with the first subcarrier, means for amplitude modulating the second subcarrier, wave with the third matrix output, means for surpressing the first and second subcarrier waves, means for frequency modulating the main carrier wave with the sidebands of the modulated first and second subcarrier waves, the frequency of the first and second subcarrier waves being such that there is a gap between the lower sideband of the first subcarrier wave and the modulation of the main carrier wave by the first output means, means for generating a pilot signal at a frequency that falls within said gap, means for frequency modulating the main carrier wave with the pilot signal, means for generating a third subcarrier wave at a frequency above that of the first and second subcarrier waves, means for amplitude modulating the third subcarrier wave with the limited fourth matrix output, means for suppressing or depressing the second subcarrier wave, means for reducing the amplitude of the modulation of the third subcarrier wave to a maximum level below the highest level therefor that would exist in the absence of such an amplitude reducing operation, filter means for removing all but a relatively small portion of the upper sideband of the third subcarrier wave and for attenuating the uppermost portion of the lower sideband of the third subcarrier wave, said filter means having a center frequency at about the edge of the lower sideband of the third subcarrier wave and an upper skirt that produces a voltage attenuation of about 6 db at the frequency of the third subcarrier wave, an equalizer means for equalizing the travel time of signals of different frequencies that pass through the filter means, and means for frequency modulating the main carrier wave in accordance with the remaining portions of the sidebands of the modulated third subcarrier wave, the frequency of the third subcarrier wave being such that the lower sideband of the third subcarrier wave is separated from the upper sidebands of the first and second subcarrier waves.

28. A broadcast system capable of transmitting and receiving a broadcast signal composed of more than two stereophonically related audio frequency input signals comprising a transmitter and at least one receiver, said transmitter including matrix means for producing audio frequency matrix output signals equal in number to said input signals and each composed of a different function of said input signals, means for generating a main carrier wave, means for frequency modulating said main carrier wave with a first matrix output signal, means for generating a pilot signal at a frequency somewhat greater than the highest audio frequency contained in said input and matrix output signals, subcarrier means for generating a plurality of subcarrier waves at frequencies which are multiples of the pilot signal frequency, means for amplitude modulating each of said subcarrier waves with a different one of the remaining matrix output signals, filter means for removing all but a relatively small portion of the upper sideband of the subcarrier wave of highest multiple frequency and for attenuating the uppermost portion of its lower sideband, said filter means being defined by a center frequency at about the edge of said lower sideband and an upper skirt that produces a voltage attenuation at about 6 db at said highest multiple frequency, time equalizer means for operating on the sideband components that pass through said filter means, said time equalizer means together with said filter means exhibiting a time delay versus frequency characteristic that is relatively constant at a given value for the high and intermediate audio frequencies of said sideband components and for said highest multiple frequency, and varies only slightly from said given value for the low audio frequencies of said sideband components, so that no more than a minimal phase distortion will be introduced during reception, means for frequency modulating the main carrier wave with said pilot signal and with the sideband components of said plurality of subcarrier waves, each receiver including means responsive to the pilot signal for regenerating and reinserting the plurality of subcarrier waves, means for detecting each of the matrix output signals and dematrix means responsive to each of the matrix output signals for reproducing each of said stereophonically related input signals.

29. A broadcast system as in claim 28 further comprising a plurality of time delay means in the transmitter for equalizing the travel time for each of the matrix output signals.

30. A broadcast system as in claim 28 wherein the broadcast signal is composed of four stereophonically related input signals, said matrix means produces four matrix output signals, and said subcarrier means generates three subcarrier waves, the first and second subcarrier waves each having a frequency at the second multiple of said pilot signal frequency and in quadrature relationship with each other, and the third subcarrier wave having a frequency at said higher multiple frequency equal to the fourth multiple of said pilot signal frequency.

31. A broadcast system as in claim 30 further comprising means for limiting the modulation of said third subcarrier wave to a maxiumum level below the highest level that would exist in the absence of limiting operation.

* * * * *